US011542650B2

(12) United States Patent
Chae et al.

(10) Patent No.: US 11,542,650 B2
(45) **Date of Patent: *Jan. 3, 2023**

(54) WASHING MACHINE

(71) Applicant: LG Electronics Inc., Seoul (KR)

(72) Inventors: Kyosoon Chae, Seoul (KR); Hyundong Kim, Seoul (KR); Sooyoung Oh, Seoul (KR); Jaeyong Jeong, Seoul (KR)

(73) Assignee: LG Electronics Inc., Seoul (KR)

( * ) Notice: Subject to any disclaimer, the term of this patent is extended or adjusted under 35 U.S.C. 154(b) by 261 days.

This patent is subject to a terminal disclaimer.

(21) Appl. No.: 16/845,903

(22) Filed: Apr. 10, 2020

(65) Prior Publication Data

US 2020/0325615 A1 Oct. 15, 2020

(30) Foreign Application Priority Data

Apr. 12, 2019 (KR) ..... 10-2019-0042789

(51) Int. Cl.
*D06F 39/02* (2006.01)
*D06F 33/37* (2020.01)
(Continued)

(52) U.S. Cl.
CPC ..... *D06F 39/022* (2013.01); *D06F 33/37* (2020.02); *D06F 33/47* (2020.02); *D06F 34/14* (2020.02);
(Continued)

(58) Field of Classification Search
CPC ..... D06F 33/37; D06F 33/47; D06F 34/14; D06F 39/02; D06F 39/022; D06F 39/088;
(Continued)

(56) References Cited

U.S. PATENT DOCUMENTS 5,435,157 A * 7/1995 Laughlin ..... D06F 39/022 68/17 R
5,564,595 A * 10/1996 Minissian ..... B67D 7/08 222/61
(Continued)

FOREIGN PATENT DOCUMENTS

CN 102108619 6/2011
CN 102421958 4/2012
(Continued)

OTHER PUBLICATIONS

Extended European Search Report in European Application No. 20169263.9, dated Aug. 5, 2020, 6 pages.
(Continued)

*Primary Examiner* — Joseph L. Perrin
(74) *Attorney, Agent, or Firm* — Fish & Richardson P.C.

(57) ABSTRACT

A washing machine includes: a tub and a detergent supply device which supplies a liquid additive to the tub, wherein the detergent supply device includes: a cartridge containing the additive; a check valve assembly including a check valve for controlling extracting of the additive, and a check valve housing forming a space in which the extracted additive is temporarily stored; a pump for extracting the additive by changing a pressure in the space; and an outlet passage through which the temporarily stored additive is discharged, wherein the check valve assembly comprises a first outlet opening communicating with the cartridge, a second outlet opening communicating with the outlet passage, a first check valve for opening and closing the first outlet opening, and a second check valve for opening and closing the second outlet opening, wherein the first and second check valves are opened in the same direction.

20 Claims, 16 Drawing Sheets

(51) Int. Cl.

| | |
|---|---|
| ***D06F 34/14*** | (2020.01) |
| ***D06F 33/47*** | (2020.01) |
| *D06F 105/42* | (2020.01) |
| *D06F 103/22* | (2020.01) |
| *D06F 105/58* | (2020.01) |
| *D06F 105/02* | (2020.01) |

(52) U.S. Cl.
CPC ..... *D06F 2103/22* (2020.02); *D06F 2105/02* (2020.02); *D06F 2105/42* (2020.02); *D06F 2105/58* (2020.02)

(58) Field of Classification Search
CPC ..... D06F 2103/22; D06F 2105/02; D06F 2105/42
See application file for complete search history.

(56) References Cited

U.S. PATENT DOCUMENTS

| | | | | |
|---|---|---|---|---|
| 6,240,953 | B1 * | 6/2001 | Laughlin | A47L 15/4436 137/561 A |
| 7,398,787 | B2 * | 7/2008 | Hsu | D06F 39/022 134/94.1 |
| 9,528,215 | B2 * | 12/2016 | Tumini | D06F 39/02 |
| 10,655,264 | B2 * | 5/2020 | Dunsbergen | D06F 39/02 |
| 10,800,644 | B2 * | 10/2020 | Hikem | G16Z 99/00 |
| 11,008,211 | B2 * | 5/2021 | Robinson | B67D 7/74 |
| 2005/0097925 | A1 * | 5/2005 | Kim | D06F 39/028 68/17 R |
| 2006/0206238 | A1 * | 9/2006 | Walker | D06F 33/37 700/283 |
| 2006/0254626 | A1 * | 11/2006 | Botts | A47L 15/0055 68/17 R |
| 2006/0272360 | A1 | 12/2006 | Hsu et al. | |
| 2010/0161143 | A1 | 6/2010 | Smith et al. | |
| 2012/0018448 | A1 * | 1/2012 | Mehus | F04B 49/065 222/63 |
| 2012/0291916 | A1 | 11/2012 | Hwang | |
| 2014/0165663 | A1 | 6/2014 | Celotto et al. | |
| 2017/0107657 | A1 | 4/2017 | Kim et al. | |

FOREIGN PATENT DOCUMENTS

| | | |
|---|---|---|
| CN | 102713045 | 10/2012 |
| CN | 105358757 | 2/2016 |
| CN | 106319875 | 1/2017 |
| CN | 106939496 | 7/2017 |
| DE | 102009030329 | 1/2010 |
| DE | 102010027991 | 10/2011 |
| EP | 2521811 B1 | 3/2015 |
| JP | 2018011618 | 1/2018 |
| KR | 1019990074113 | 10/1999 |
| KR | 1020110099288 | 9/2011 |
| KR | 101257703 | 4/2013 |
| KR | 1020130062271 | 6/2013 |
| WO | WO2015074688 | 5/2015 |
| WO | WO2017119593 | 7/2017 |

OTHER PUBLICATIONS

PCT International Search Report in International Application No. PCT/KR2020/004933, dated Aug. 3, 2020, 3 pages.
Office Action in Chinese Appln. No. 202010285879.4, dated Apr. 26, 2022, 19 pages (with English translation).

* cited by examiner

WASHING MACHINE

CROSS-REFERENCE TO RELATED APPLICATION

This application claims the benefit of priority to Korean Application No. 10-2019-0042789, filed on Apr. 12, 2019, the disclosure of which is incorporated in its entirety.

BACKGROUND OF THE INVENTION

1. Field of the Invention

The present disclosure relates to a washing machine, and more particularly, to a washing machine capable of automatically supplying detergent.

2. Description of the Related Art

A washing machine is an apparatus for processing laundry through various actions such as washing, dehydration and/or drying. A washing machine is an apparatus that removes contamination from laundry (hereinafter, also referred to as "cloth") by using water and detergent.

Accordingly, there is an increasing demand for an automatic detergent supply device that automatically mixes and supplies various types of detergents to suit the fabric, and related technologies are actively being developed.

Patent Publication No. 10-2013-0062271 (hereinafter also referred to as "prior document 1") discloses a description of a metering system for discharging at least three different preparations based on a washing machine washing program. However, the prior document 1 does not disclose a specific valve structure for supplying and blocking detergent into the dispenser.

Japanese Patent Application Laid-Open No. 2018-11618 (hereinafter also referred to as "prior document 2") discloses a gear pump configuration for automatic detergent supply. However, prior document 2 discloses only a water supply valve, and a valve for opening and closing a tank containing detergent is not disclosed. In addition, there is a problem that the detergent is in contact with the gear pump.

SUMMARY OF THE INVENTION

The present disclosure has been made in view of the above problems, and provides a washing machine capable of automatically injecting additives such as detergent stored in a cartridge into a tub.

The present disclosure further provides a washing machine that prevents the additive from contacting the pump.

The present disclosure further provides a check valve that automatically injects detergent by using a pump and a check valve, and increases space utilization.

In order to achieve the above object, a washing machine according to an embodiment of the present disclosure includes a detergent supply device capable of supplying an additive to the washing machine.

The detergent supply device may supply an additive to the tub. The additive may be a liquid additive.

The detergent supply device includes: a cartridge containing the additive; a check valve assembly including a check valve for controlling extracting of the additive, and a check valve housing forming a space in which the extracted additive is temporarily stored; a pump for extracting the additive by changing a pressure in the space formed in the check valve assembly; and an outlet passage through which the temporarily stored additive is discharged, The check valve assembly includes a first outlet opening communicating with the cartridge and a second outlet opening communicating with the outlet passage that are formed in the check valve housing, and includes a first check valve for opening and closing the first outlet opening, and a second check valve for opening and closing the second outlet opening, wherein the first and second check valves are opened in the same direction.

The first and second check valves are formed of an elastic material, and formed integrally together.

Each of the first and second check valves includes: a lid having one surface of which at least a part is flat, and opening and closing the outlet opening; and a valve neck protruding from the one surface.

First and second insertion holes are formed in a center of the first and second outlet openings.

The valve necks of the first and second check valves are respectively inserted into the first and second insertion holes.

The first and second check valves include a step portion having a diameter enlarged from a distal end of the valve neck.

The step portion of the first and second check valves are respectively fixed to a rear surface of the first and second insertion holes.

Each of the first and second check valves is disposed such that a flat portion of one surface of the lid is in contact with first and second discharge surfaces in which the first and second outlet openings are formed.

The valve neck protrudes in a direction of the cartridge, and the first and second check valves are opened in an opposite direction to the cartridge.

The check valve assembly includes: a docking pipe connected to the cartridge and having a first space formed therein; a first check valve housing connected to the docking pipe and forming a second space, between the first check valve and the second check valve, where the extracted additive is temporarily stored; and a second check valve housing connected to the first check valve housing and forming a third space located between the second check valve and the passage.

The docking pipe has one end of the outlet passage side which protrudes into the first check valve housing.

The check valve assembly includes a check valve cap coupled to one end of the docking pipe.

The first outlet opening is formed in the check valve cap.

The docking pipe has the other end of the cartridge side which is inserted into the cartridge.

A detergent inlet opening for communicating the first space and the cartridge is formed in a lower portion of the inserted portion.

The docking pipe is formed to be inclined upward toward the other end from the one end.

The detergent supply device includes a docking valve which is installed in the cartridge, and connects the cartridge and the docking pipe.

The pump extracts the additive by changing air pressure in the second space.

The pump includes a cylinder communicating with the second space, and a piston reciprocating within the cylinder.

Volume of the second space is equal to or greater than volume of an area where the piston reciprocates.

The detergent supply device includes an inlet passage for transmitting a pressure change by the pump to the second space.

The check valve assembly includes an inlet passage connecting pipe coupled to the first check valve housing from above the second check valve housing.

The inlet passage is coupled to the inlet passage connecting pipe.

The check valve assembly includes an outlet passage connecting pipe coupled to the second check valve housing.

The outlet passage is coupled to the outlet passage connecting pipe.

A plurality cartridge are provided, each of the plurality of cartridges contains the additive, a plurality check valve assemblies are provided, and the plurality of check valve assemblies are respectively connected to the plurality of cartridges.

BRIEF DESCRIPTION OF THE DRAWINGS

FIGS. 11A and 11B are cross-sectional views showing the cartridge and the check valve assembly of FIG. 8, wherein FIG. 11A shows a state that the cartridge and the check valve assembly are disassembled, and wherein FIG. 11B shows a state that the cartridge and the check valve assembly are assembled.

DESCRIPTION OF EXEMPLARY EMBODIMENTS

Figure 1:
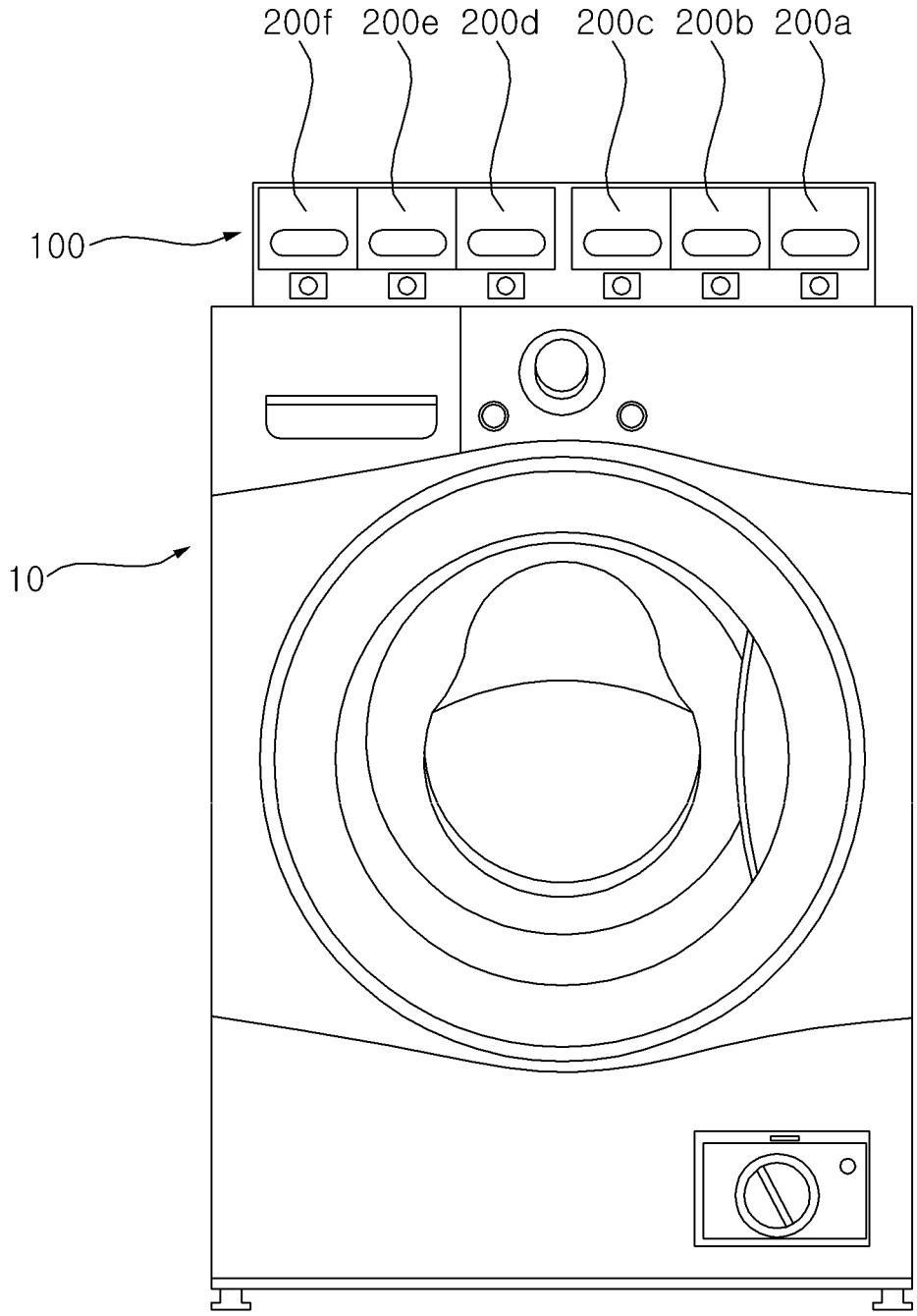
FIG. 1 is a front view showing a washing machine according to an embodiment of the present disclosure.

Advantages and features of the present disclosure and methods of achieving the advantages and features will be apparent with reference to embodiments described below in detail in conjunction with the accompanying drawings. However, the present disclosure is not limited to embodiments disclosed below, but may be implemented in various forms, only the present embodiments are provided so that a disclosure of the present disclosure is complete and a disclosure of a scope of the invention is fully understood by those skilled in the art to which the present disclosure belongs, and the present disclosure is only defined by the scope of the claims. The same reference numerals indicate the same components through the specification.

Hereinafter, a washing machine according to an exemplary embodiment of the present disclosure will be described with the accompanying drawings.

Figure 2:
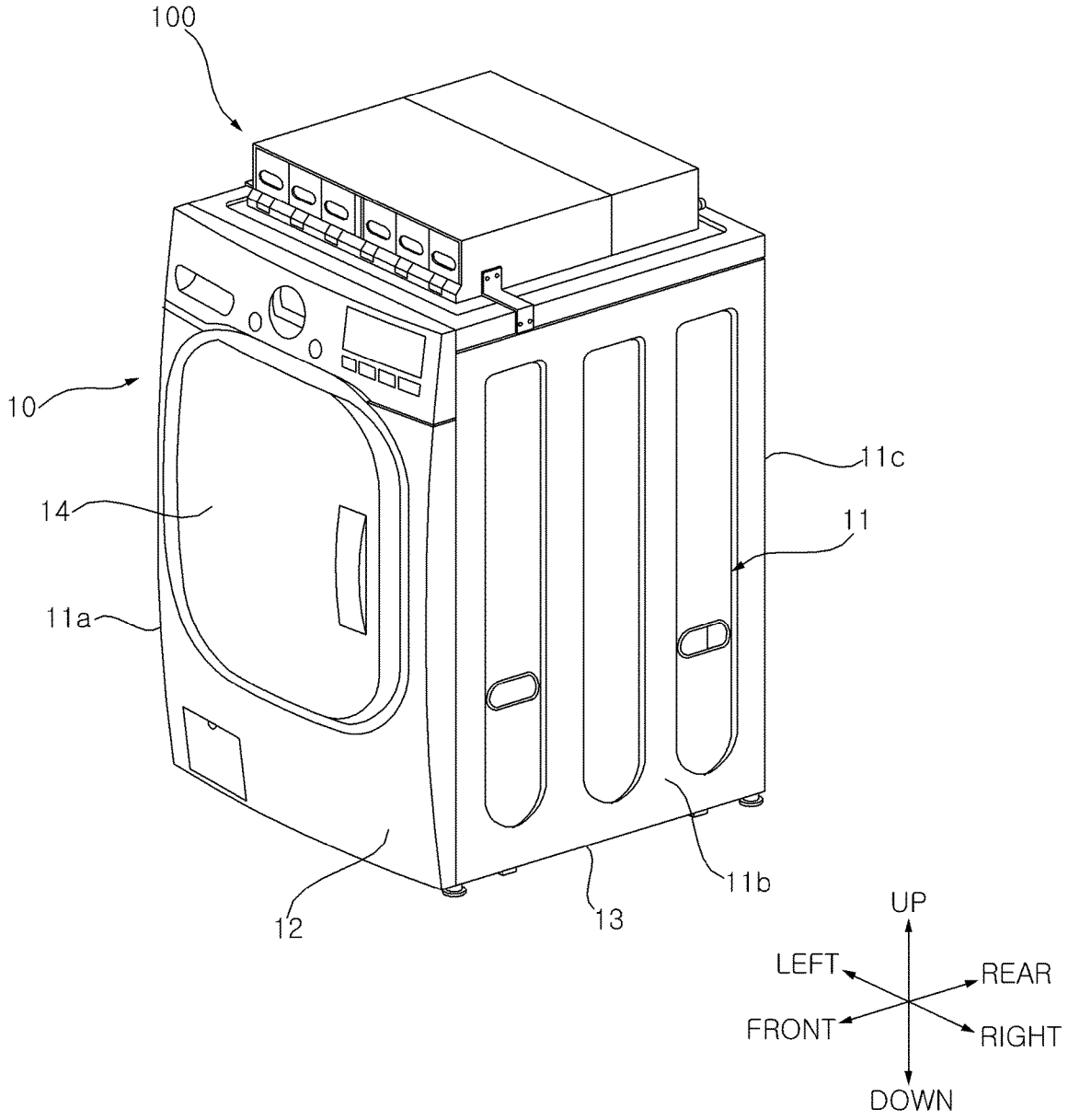
FIG. 2 is a perspective view showing a washing machine according to an exemplary embodiment of the present disclosure.
Figure 3:
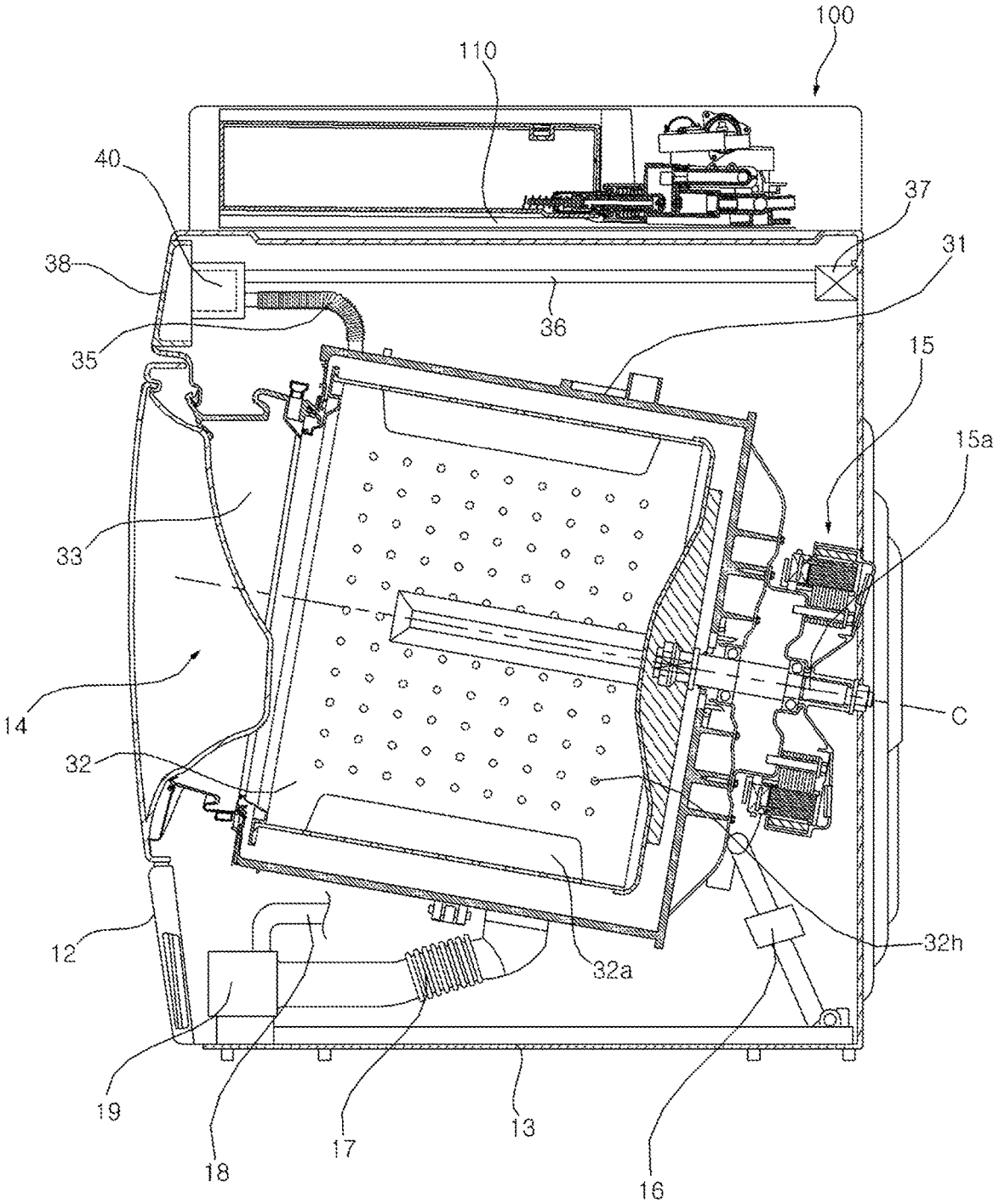
FIG. 3 is a lateral cross-sectional view showing the washing machine according to an exemplary embodiment of the present disclosure.

Referring to FIG. 1 to FIG. 3, a washing machine according to an exemplary embodiment of the present disclosure includes a tub 31 containing water, a drum 32 disposed in the tub 31, the drum 32 receiving laundry and a detergent supply device supplying detergent, fabric softener, bleach (hereinafter referred to as "additive") and the like to the tub 31. Further, the washing machine includes a cabinet 10 receiving the tub 31 and the drum 32. There may be provided with the detergent supply device 100 on an upper surface of the cabinet 10 in state of being separated from a body of the washing machine, otherwise the detergent supply device 100 is installed inside the cabinet 10 integrally with the body of the washing machine. Hereinafter, a detergent supply device 100 in case of being separately employed on the body of washing machine will be described.

The cabinet 10 is formed as an appearance of the washing machine, and the tub 31 and the drum 32 are disposed in the cabinet 10. The cabinet 10 includes a main frame 11 having a front surface opened, a left surface 11*a*, a right surface 11*b* and rear surface 11*c*, a front panel 12 having a loading/unloading opening and connected to a front surface of the main frame 11, and a planar base 13 supporting the main frame 11 and the front panel 12 from the below. A door 14 opening or closing the loading/unloading opening is mounted rotatably to the front panel 12.

The front panel 12 and the tub 31 are communicated to each other through a circular gasket 33. A frontal end portion of the gasket 33 is mounted at the front panel 12 and a rear end portion of the gasket 33 is mounted fixedly along a circumference of an inlet of the tub 31. The gasket 33 is formed as a material having elasticity and capable of preventing water in the tub 31 from leaking.

A driving portion 15 is disposed at a rear side of the drum 32 so as to rotate the drum. Further, there may be provided with a water supply hose (not shown) guiding water supplied from an external water source and a water supply portion 37 controlling water supplied from the water supply hose to a water supply passage 36. The water supply portion 37 may include a water supply valve (not shown) opening or closing the water supply passage 36.

The cabinet 10 includes a drawer 38 receiving detergent (hereinafter also referred to as "additive") and a drawer housing 40 receiving the drawer 38 so that the drawer 38 is withdrawable therefrom. The additive may also include bleach or fabric softener as well as detergent for laundry. Additive contained in the drawer 38 is provided to the tub 31 by a water supply bellows 35 when water is supplied through the water supply passage 36. There may be provided with a water supply hole (not shown) connected to the water supply bellows 35 at a side of the tub 31.

The tub 31 may include a drain discharging water, and a drain bellows 17 may be connected to the drain. A drain pump 19 pumping water discharged from the tub 31 through the drain bellows 17 so as to discharge the water to the outside of the washing machine.

Referring to FIG. 5 to FIG. 8, the detergent supply device 100 includes a cartridge 200 containing additive, a check valve assembly 400 having check valves 420, 470 and check valve housings 410, 460, a pump 500 sucking additive by changing a pressure of a space formed in the check valve assembly 400 and an outlet passage 800 discharging additive sucked from the check valve assembly 400.

The check valves 420, 470 determine whether to suck additive. The check valve assembly 400 functions to form a space S2 temporarily receiving additive sucked.

There may be respectively provided with a plurality of cartridges and check valve assembly 400. Additive may be contained in each of the plurality of cartridges 200*a*, 200*b*, 200*c*, 200*d*, 200*e*, 200*f* (hereinafter referred to as "200"), and alternatively different kinds of additives may be contained in each of them. The plurality of check valve assemblies 400*a*, 400*b*, 400*c*, 400*d*, 400*e*, 400*f* (hereinafter referred to as "400") may be connected respectively to the plurality of cartridges 200.

The detergent supply device 100 may include a plurality of passages 700*a*, 700*b*, 700*c*, 700*d*, 700*e*, 700*f* respectively connected to the plurality of check valve assemblies 400, an inlet passage 700 transferring change of pressure formed by the pump 500 to the check valve assembly 400 and a passage switching valve 600 selectively communicating one of the plurality of passages 700*a*, 700*b*, 700*c*, 700*d*, 700*e*, 700*f* (hereinafter referred to as "700") of the inlet passage 700 to the pump 500. Further, detergent supply device 100 may include an electrode sensor 300 detecting an amount of additive contained in a cartridge 200 and a water supply valve 830 receiving water from an external water source.

The space S2 is formed at the check valve assembly 400, wherein the space S2 functions to temporarily receive additive sucked therefrom. The pump 500 functions to suck additive from the plurality of cartridges by changing pressure of the space S2. The outlet passage 800 includes a plurality of check valve connectors 850*a*, 850*b*, 850*c*, 850*d*, 850*e*, 850*f* (hereinafter referred to as "850") respectively connected to the plurality of check valve assemblies so that additive sucked is discharged to the outlet passage 800.

The water supply device 100 includes a housing 110 having a door disposed at a front side thereof and defining an accommodating room inside thereof, and a cover 120 opening or closing the housing 110.

An opening formed as a rectangular cuboid made of various surfaces is disposed at a front side of the housing 110, and each of the opening is extended from a rear side of the housing 110 so as to form a cartridge receiving room corresponding to each of the opening. That is, each of a plurality of cartridges 200*a*, 200*b*, 200*c*, 200*d*, 200*e*, 200*f* (hereinafter referred to as "200") may be inserted to the each cartridge receiving room.

Detergent may be contained in the cartridge 200, and alternatively various detergent having various composition ratio may be contained in the cartridge 200 in case of employing the plurality of cartridges. The number of cartridges according to an exemplary embodiment of the present disclosure is six, but it is not limited thereto.

A receiving room is formed at a rear space of the cartridge 200 so that passages 700, 800, a passage switching valve 600 and a pump 500 and something like detergent supply parts are received. A rear wall 111 is installed between the cartridge receiving room and the receiving room for parts in which an electrode sensor 300 including a terminal and an electrode sensor 300 as the followings is installed at the rear wall 111*a*.

Figure 4:
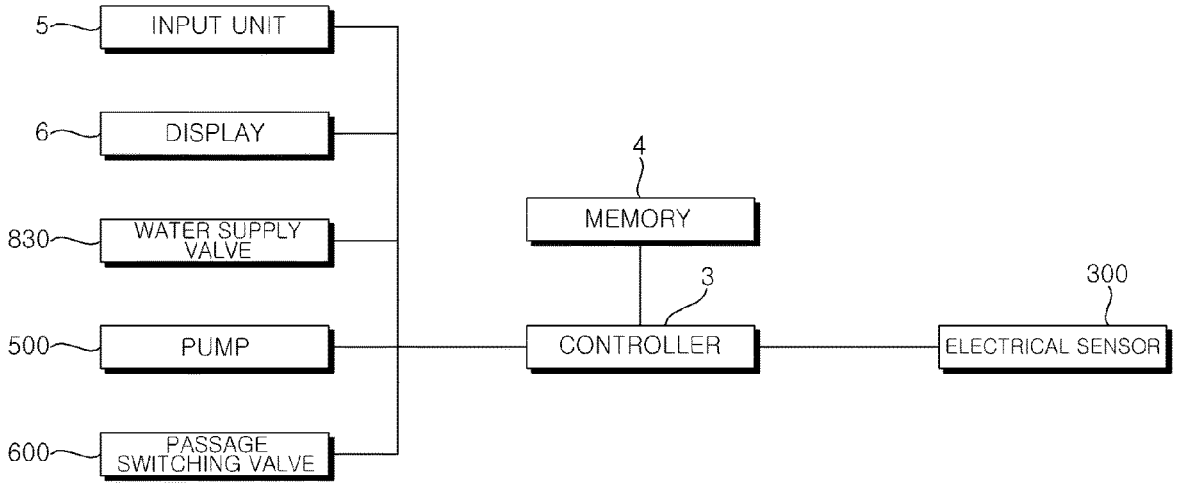
FIG. 4 is a block diagram showing a control of the washing machine according to an exemplary embodiment of the present disclosure.
Figure 5:
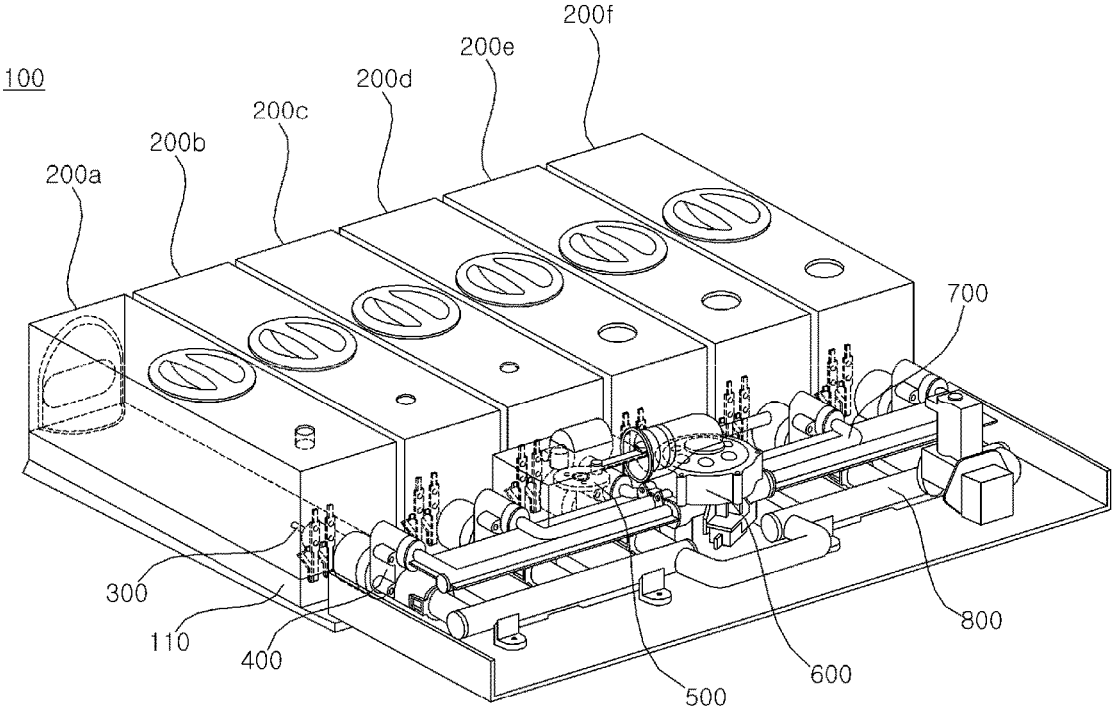
FIGS. 5 and 6 are perspective views showing a detergent supply device according to an exemplary embodiment of the present disclosure.
Figure 6:
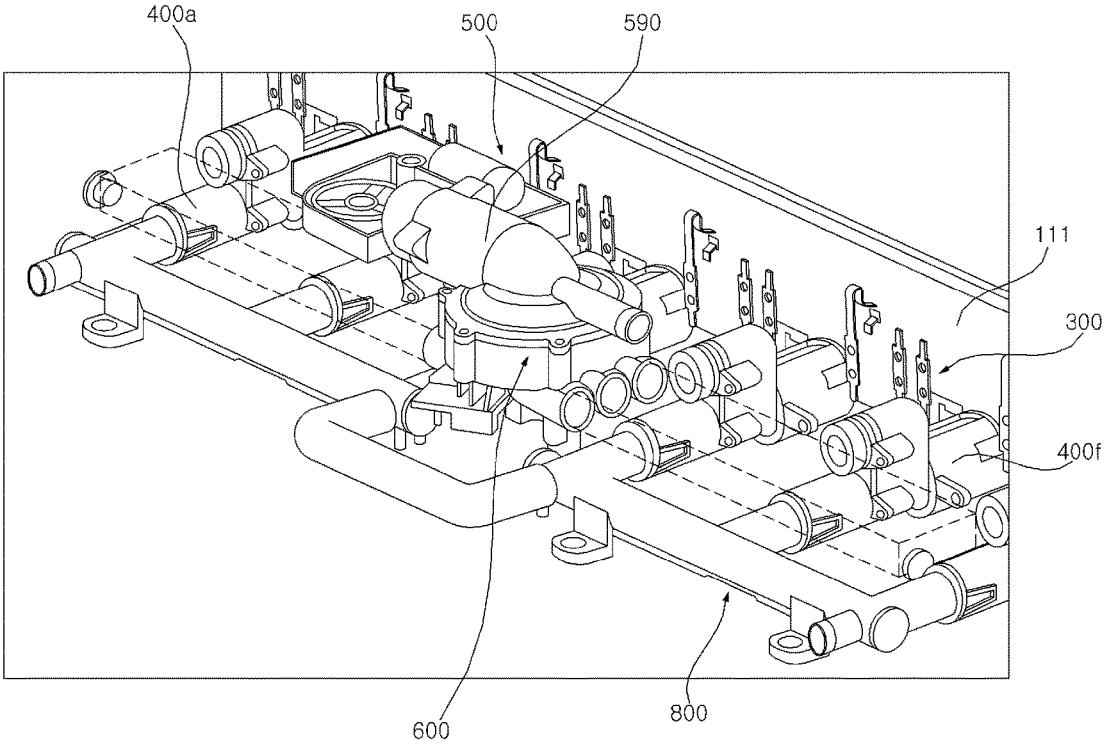
Figure 7:
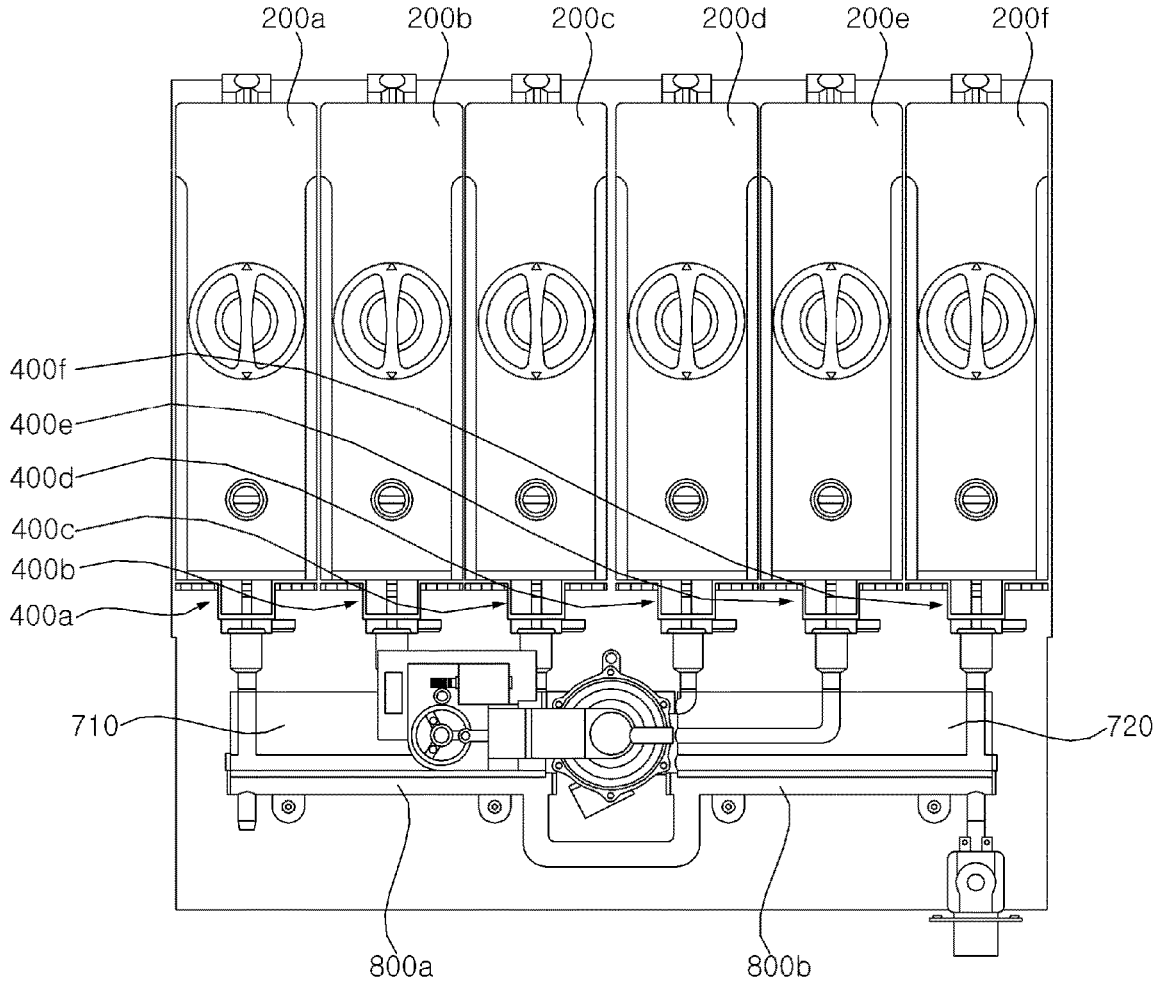
FIG. 7 is a top view showing the detergent supply device according to an exemplary embodiment of the present disclosure.

Referring to FIG. 4, the detergent supply device 100 may include the pump 500 and a controller 3 controlling the passage switching valve 600, and so on. The controller 3 may be installed on the body of washing machine, and alternatively may be separately in the detergent supply device 100 so as to transmit or receive information with the controller 3 installed on the body of washing machine.

A pump 500 and a passage switching valve 600 may be controlled by the controller 3. Information about contents of additive and various composition ratio of contents may be stored in a memory 4. One of the contents is contained in each of the plurality of cartridges 200*a*, and the controller 3 controls the pump 500 and the passage switching valve 600 according to information stored in the memory 4.

The washing machine may further include an input unit 5 for obtaining various control command related with an operation of the washing machine from a user. The input unit 5 may be disposed at an upper side of the front panel 12. A display 6 for indicating the operating status of the washing machine may be disposed at the front panel 12.

The controller 3 may select a type of additive from the memory 4 according to an input value inputted by a user through the input unit 5, and the controller 3 may identify information about the additive. And, the controller 3 may control the pump 500 and the passage switching valve 600 so as to suck the selected additive. Thus, the controller 3 may control the pump 500 corresponding to the cartridge 200 containing the selected additive base on a composition ratio and control the passage switching valve 600.

Hereinafter, referring to FIG. 5 to FIG. 11B, cartridge 200 according to an exemplary embodiment of the present disclosure will be described.

The cartridge 200 includes a cartridge body 210 containing additive, wherein the cartridge body 210 is formed as a body of the cartridge 200, a first opening 211 allowing additive to go into the cartridge body 210, a cap 220 opening/closing the first opening 211, a membrane 230 allowing air in the cartridge to circulate to outside, a second opening 213 having the membrane 230, a cartridge locker 240 allowing the cartridge 200 to be secured to the housing 110 in a case that the cartridge is insertly installed on the housing 110, a docking valve 250 connecting a check valve assembly 400 and the cartridge 200 and a rib 260 preventing additive from being contacted to the membrane 230.

The cartridge body 210 is formed so as to be insertly mounted to a cartridge accommodating space formed at a front side of the housing 110 in which the cartridge body 210 is formed as being corresponded to an appearance of the housing 110. According to an exemplary embodiment of the present disclosure, a cartridge container 110 is formed as being cuboid-shaped, further the cartridge 200 is also formed as being cuboid-shaped so as to be corresponded thereto, and at this time an edge of the cartridge container 110*a* is formed so as to be rounded.

A docking valve insert opening is formed at a surface of the cartridge body 210, the docking valve 250 may be installed on the cartridge body 210 in state of being inserted to the docking valve insert opening. The docking valve insert opening may be formed at a rear side of the cartridge body 210. The docking valve insert opening may be disposed at a lower side of the rear side. Herein, even though the cartridge is filled with a little amount of additive, the additive in the cartridge can be discharged through the docking valve 250 to the check valve assembly 400.

As a reason of the forgoing, the cartridge 200 may be installed with a downward slope towards a rear. Specifically, the cartridge 200 may include the cartridge body 210 having a bottom surface disposed with a downward slope toward a direction that the docking valve insert opening is formed. In a case that the docking valve insert opening is disposed at a rear surface of the cartridge body 210, the cartridge 200 may have the cartridge body 210 in which an inner bottom surface of the cartridge body 210 is inclined downward toward a rear.

Further, the outlet passage 800 of the docking pipe 440 has a first end and a second end facing the cartridge 200 wherein the second end is inclined upwardly than the first end. In other words, the farther from a front side of the docking pipe 440, the more inclined downwardly a rear side of the docking pipe 440 is. In the same manner, the farther from a front side of the docking valve 250, the more inclined downwardly a rear side of the docking valve 250 is.

Figure 11A:
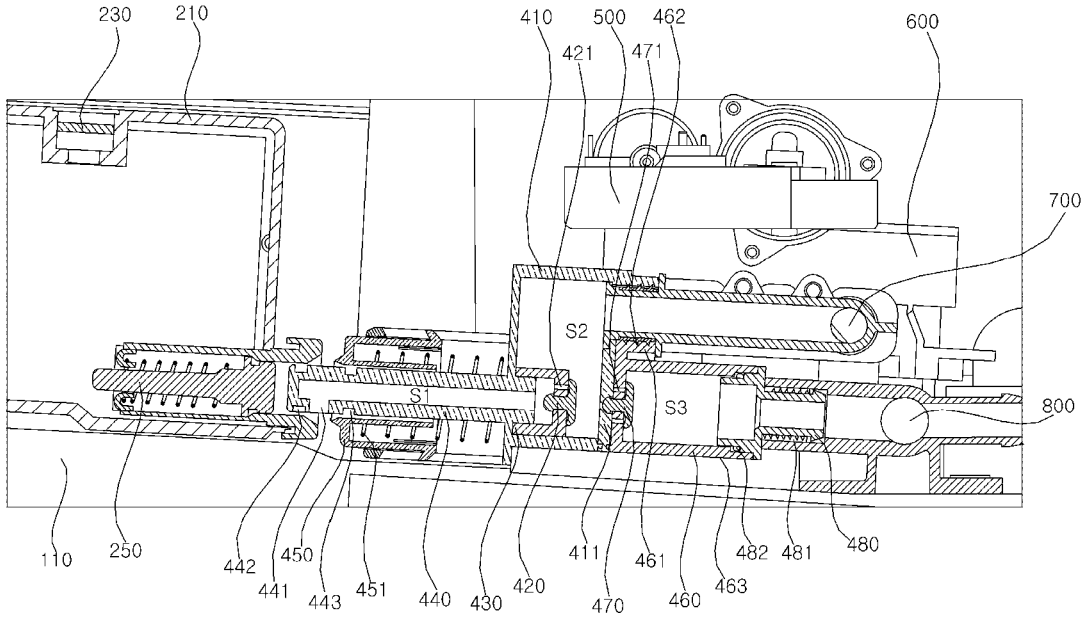
Figure 11B:
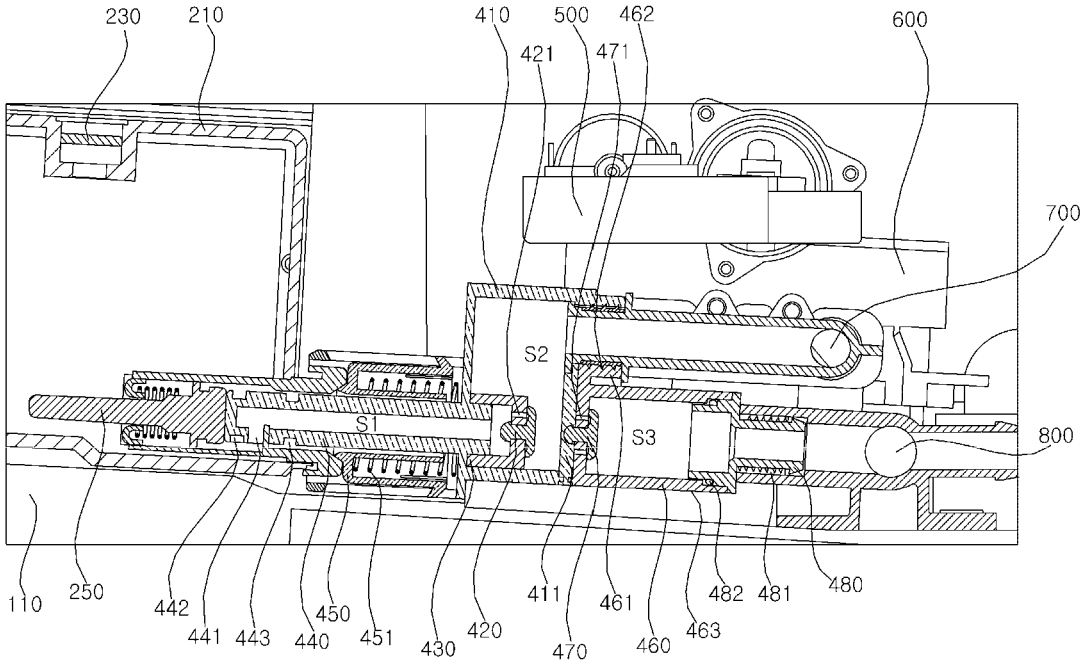

FIG. 11A shows a state that the cartridge 200 is separated from cartridge accommodating space of the housing 110 so as to disassemble docking valve 250 and the docking pipe 440. FIG. 11B shows a state that the cartridge 200 is insertly installed on cartridge receiving space of the housing 110 so as to assemble the docking valve 250 to the docking pipe 440

The docking valve 250 includes a docking valve housing installed on the cartridge 200, a docking valve cover installed in the docking valve housing, a docking valve shaft supporting the docking valve cover and a docking valve spring encompassing the docking valve shaft.

When the cartridge 200 is separated from the cartridge receiving space of the housing 110, the docking valve cover is moved rearwardly by an elastic restoring force of the docking valve spring, and the docking valve is closed. Therefore, even if the cartridge 200 is separated from the cartridge receiving space in a state of containing additive, the additive contained in the cartridge 200 is not leaked.

When the cartridge 200 is insertly installed on the cartridge accommodating space of housing 110, the docking valve cover is moved forwardly by a pressing force of the docking pipe 440, and then the docking valve 250 is opened. When the cartridge 200 is inserted to the cartridge receiving space, an elastic force of the docking valve spring and a docking pipe spring 451 in the followings is exerted to the cartridge 200. However, the cartridge 200 can be secured by the cartridge locker 240 as described above. When the docking valve 250 is opened, additive contained in the cartridge 200 is guided through a detergent inlet opening 441 to a docking pipe space S1.

When the cartridge locker 240 is released, the cartridge 200 is separated toward a front side by the docking valve spring and the docking pipe spring 451. Therefore, a user can easily separate the cartridge 200 from the cartridge housing 110.

Hereinafter, referring to FIG. 5 to FIG. 8 and FIG. 10, a structure and a function of an electrode sensor 300 disposed at a rear side of the cartridge will be described.

The electrode sensor 300 according to an exemplary embodiment of the present disclosure is disposed at the rear wall 111*a* which is formed at a rear side of the cartridge 200 inserted in the housing 110. Specifically, electrode plate 321*a*, 321*b*, 321*c* are installed between the rear wall and the cartridge body 210. A terminal 311*a*, as an example among terminals 311*a*, 311*b*, 311*c* provided is installed on a rear wall protrusions 111*a*1 protruding in an opposite direction to the cartridge. The terminal 311*a* includes a protrusion 311-1 having a curvature bending forward. The protrusion 311-1 may push the electrode plate 321 toward the cartridge simultaneously in a state of being contacted to the electrode plate 321, so an electric signal can be obtained from the electrode plate 321.

The electrode plate 321 is connected to the terminal 311 through a rear wall electrode plate opening 112-1. And the electrode plate 321 is contacted to the inside of the cartridge through a cartridge electrode plate opening (not shown). Thus, an electric current may flow in a state of being contacted with additive contained in the cartridge at the front side, and then an electric signal may be transmitted to the controller 3 through the terminal of rear side.

According to an exemplary embodiment of the present disclosure, three terminals and three electrode plates are respectively disposed per one cartridge. A first terminal 311*a*, a first electrode plate 321*a*, a second terminal 311*b* and a second electrode plate 321*b* are disposed at a lower side of the cartridge and at a side of the docking valve 250.

Third terminal 311*c* and third electrode plates 321*c* are disposed at an upper side of the cartridge and at the other side of the docking valve 250*a*.

The electrode sensor 300 outputs a signal when positive and negative electrodes closely spaced apart from each other is electrified through a medium. Thus, when the cartridge is filled with enough additive, additive functions as a medium so that they are electrified, and in doing so, the terminal determines an amount of additive contained in the cartridge.

In a case that there is provided with two electrode plates of an electrode sensor 300 and two terminals 311 at each cartridge, there may be a problem that the electrode sensor misjudges an amount of additive contained in the cartridge because sway of the electrode sensor or hardened additive on the electrode sensor.

According to an exemplary embodiment of the present disclosure, the first and second electrode plates 321*a*, 321*b* may be separate. In other words, the first and second electrode plates 321*a*, 321*b* are installed on a lower side of the cartridge 200, and the third electrode plate 321*c* is installed on an upper side of the cartridge 200. That is, when the first and second electrode plates 321*a*, 321*b* are electrified, a first signal can be obtained, and when the first electrode plate 321*a* or second electrode plate is electrified with the third electrode plate 321*c*, a second signal can be obtained. Therefore, it is possible to detect residual quantity of additive by adding the first signal and the second signal, and further it is possible to determine whether the electrode sensor is out of order or unmounted.

Specifically, when the first and second signal are not detected, it is determined that the cartridge is almost empty or unmounted. When only the second signal is detected, it is determined that the electrode sensor is out of order or under bad connection. When only the first signal is detected, it is determined that the cartridge is lack of additive. When the first and second signals are detected, it is determined that the cartridge is filled with enough additive.

The display 6 may indicate a result of the first and second signal so that a user can easily recognize it. Meanwhile, according to an exemplary embodiment of the present disclosure, there is provided with the first and second electrode plate installed on a lower side thereof and the third electrode plate installed on an upper side thereof, but it is not limited thereto. Rather, it is preferable to employ at least three electrode plates or more so as to reduce a chance to misjudge a residual quantity of additive contained in the cartridge.

According to an exemplary embodiment of the present disclosure, the first and second electrode plates 321*a*, 321*b* are formed in a shape of 'L' rather than a shape of rectangular as a conventional manner. That is, if the two electrodes are placed closely to each other, a wrong signal can be detected by an interference between the two electrodes. Therefore, a width of a lower side of the electrode plate which detergent is contacted can be made thinly so as to reduce the interference between the first and second electrodes. At this time, an appearance of the electrode plate is not limited to a shape of 'L' as long as an interference is minimized.

Hereinafter, referring to FIG. 5 to FIG. 8 and FIG. 11A to FIG. 16, a structure of the check valve assembly will be described.

The check valve assembly 400 is respectively connected to the cartridge 200 so as to determine whether to suck additive. Each of the plurality of check valve assemblies 400 is connected to each of the plurality of cartridges 200 so as to determine whether to suck additive. The check valve assembly 400 includes a space S2 temporarily storing additive sucked. A pressure generated in the space S2 is changed by the pump 500, and in doing so additive contained in the cartridge sucked to the space S2.

The check valve assembly 400 may include a first check valve housing 410 having the space S2 temporarily storing additive sucked from the cartridge 200, a first check valve 420 installed on the first check valve housing 410, a second check valve housing 460 communicated with the first check valve housing 410, the second check valve housing 460 respectively connected to the plurality of check valve connectors 850 disposed at the outlet passage 800 and a second check valve 470 installed on the second check valve housing 460.

Further, the check valve assembly 400 may include a check valve cap 430 prevent additive and air from leaking through the first check valve 420 and a docking pipe 440 mounted to the docking valve 250 of the cartridge 200 so as to transfer additive contained in the cartridge 200 toward a direction of the check valve.

A first outlet opening 421 communicated with the cartridge 200 and a second outlet opening 471 communicated with the outlet passage 800 may be formed at the check valve assembly 400. The first and second outlet openings may be installed at the valve housings 420, 460. The first outlet opening 421 may be formed at the check valve cap 430, and the second outlet opening 471 may be formed at the second check valve housing 460. The first check valve 420 opens or closes the first outlet opening 421. The second check valve 470 opens or closes the second outlet opening 471. The first and second check valves are opened in the same direction.

The first outlet opening 421 may be formed at the first check valve housing 410 in which the first outlet opening 421 is communicated with the cartridge 200. The space S2 of the first check valve housing 410 is communicated with the cartridge 200 through the space S1 formed at the docking pipe in the followings and the first outlet opening 421.

The first check valve 420 determines whether to open or close the first outlet opening 421 so that additive contained in the cartridge 200 is guided to the space S2 of the first check valve housing 410. When the first check valve 420 is placed far from an adjacent portion (hereinafter also referred to as 'a first outlet surface') of the first outlet opening 421 of the first check valve housing 410 so as to open the first outlet opening 421, additive contained in the cartridge 200 can be guided to the space S2 of the first check valve housing 410. When the first check valve 420 is contacted with an adjacent portion (hereinafter also referred to as 'a second outlet surface') of the first outlet opening 421 of the first check valve housing 410 so as to close the first outlet opening 421, the additive contained in the cartridge 200 is not guided to the space S2 of the first check valve housing 410.

The first check valve housing 410 includes an inlet passage connector 461 connected to the inlet passage. The inlet passage connector 461 is snugly mounted to the inlet passage 700 through an inlet passage connecting cover 462. The plurality of check valve assemblies 400 are respectively connected to the plurality of passages 700*a*, 700*b*, 700*c*, 700*d*, 700*e*, 700*f* of the inlet passage 700 in the followings through the inlet passage connector 461.

Meanwhile, the first check valve housing 410 may have an end having the first outlet opening and the other end which is opened and connected to the second check valve housing 460 having the inlet passage connector 461 so that the check valve assembly 400 and the inlet passage 700 are connected to each other.

Alternatively, detergent inlet openings 441 are formed at the docking pipe 440, in which the detergent inlet opening allows additive supplied from the cartridge 200 to be guided through the docking valve 250, and a passage (hereinafter referred to as a space S1) communicated with the detergent inlet opening 441 is formed inside the docking pipe 440.

The docking pipe 440 may have an end facing a rear side (e.g., a direction facing the outlet passage 800), in which the end protrudes toward inside the first check valve housing 410. The check valve cap 430 may be mounted to the end protruding toward inside the space S2 of the first check valve housing 410. The check valve cap 430 is mounted to the end of the docking pipe 440. The first outlet opening 421 and a first insert hole 422 are formed at the check valve cap 430. The first check valve 420 is inserted to the first insert hole 422. So, additive contained in the cartridge 200 is not sucked when the pump 500 is not in an operation.

The docking pipe 440 has an end facing a front side (a direction facing the cartridge 200) in which the end is inserted inside the cartridge 200, wherein the detergent inlet opening 441 may be formed at a portion which the end is inserted. The detergent inlet opening 441 is formed at a lower side of the docking pipe 440 so that additive can be easily sucked even if the cartridge 200 is filled with a little of additive.

Referring to FIGS. 11A and 11B, when the cartridge 200 is insertly installed at the cartridge receiving space of the housing 110, the docking valve 250 is opened, so the additive contained in the cartridge 200 is guided into the space S1 through the detergent inlet opening 441.

The check valve assembly 400 may include a docking pipe circumference 450 mounted to the docking valve 250 at a circumference of the docking pipe. A front surface of the docking pipe circumference 450 may be contacted to a rear surface of the docking valve housing forming as an appearance of the docking valve 250. Further, a docking pipe spring 451 may be installed at the docking pipe circumference 450. Therefore, the check valve assembly 400 can be fixedly mounted to the docking valve 250 by an elastic force of the docking valve 250 and the docking pipe spring 451.

The first check valve housing 410 and the second check valve housing 460 are mounted to each other through a check valve o-ring 411 disposed between the first check valve housing 410 and the second valve housing 460 so as to form an air-tight. Alternatively, the first check valve housing 410 and the second check valve housing 460 can be integrally formed.

A first docking pipe o-ring 442 and a second docking pipe o-ring 443 are insertly installed at a first docking pipe o-ring groove 442*a*-1 and a second docking pipe o-ring groove 443*a*-1 at the both sides of the detergent inlet opening 441. This is for preventing additive from leaking to outside while additive is put into the detergent inlet opening 441.

The second outlet opening 471 is formed at the second check valve housing 460 wherein the second outlet opening 471 is communicated with the space S2 of the first check valve housing 410. The second check valve housing 460 is mounted to an outlet passage connector 480 so as to form a space S3 therein.

The outlet passage connector 480 may be integrally formed at the second check valve housing 460, or otherwise separated so as to be mounted to the second check valve housing 460. The outlet passage connector 480 is connected to the check valve connector 850 of the outlet passage 800 so as to communicate the space S3 of the second check valve housing 460 with the outlet passage 800. The second check valve housing 460 includes the inlet passage connector 461 connected to the inlet passage 700 and an outlet passage connector 463 connected to the outlet passage 800. The inlet passage connector 461 is contactly mounted to the inlet passage 700 through the inlet passage connecting cover 462.

The outlet passage connector 480 is mounted to the outlet passage connector 463 disposed at an end of the second check valve housing 460, and is fixedly mounted to the second check valve housing 460 by an outlet passage connecting o-ring 482. The outlet passage connector 480 is snugly mounted to the check valve connector 850 of the outlet passage 800 by an outlet passage connecting cover 481. The second check valve 470 determines whether to guide additive from the space S2 of the first check valve housing 410 to the space S3 of the second check valve housing 460 by opening or closing the second outlet opening 471. When the second check valve 470 opens the second outlet opening 471 by spacing apart from a circumference of the second outlet opening 471 of the second valve housing 460, additive temporarily contained in the space S2 of the first check valve housing 410 can be discharged into the space S3 of the second check valve housing 470. When the second check valve 470 closes the second outlet opening 471 by contacting with a circumference of the second outlet opening 471 of the second check valve housing 460, additive temporarily contained in the space S2 of the first check valve housing 410 is not discharged into the space S3 of the second check valve housing 460.

The first check valve 420 may be disposed so as to open or close the first outlet opening 421 at the inside S2 of the first check valve housing 410, and the second check valve 470 may be disposed so as to open or close the second outlet opening 471 at the inside S3 of the second check valve housing 460. The first check valve 420 and the second check valve 470 may be installed so as to be opened in the same direction.

At this moment, if the two check valves 420, 470 are installed so as to be opened in a different direction each other, it is impossible to generate a negative pressure in the space S2 to suck additive. According to an exemplary embodiment of the present disclosure, among the check valves 420, 470, the first check valve 420 can be opened only along a direction of the space S2, and the second check valve 470 can be opened only along a direction of the space S3.

The first and second check valves 420, 470 are made of material having an elastic force. For example, the first and second check valves 420, 470 may be a rubber having an elastic force. The first and second check valve 420, 470 can be formed integrally together.

The first and second check valves 420, 470 may include lids 424, 474 for opening or closing the outlet opening and valve necks 425, 475 protruded from the lids 424, 474. Further, the first and second check valves 420, 470 may include step portion 426, 476 having an extending diameter from an end of the valve necks 425, 475.

The lids 424, 474 may be formed substantially in a hemispherical shape. The lids 424, 474 have one surface, which is an outlet opening side, that is flat. This does not mean that the entire surface is flat. At least a portion of one surface may be flat, and one surface may have a flat surface surrounding the outlet openings 421 and 471.

When the check valves 420 and 470 close the outlet openings 421 and 471, the flat portion of one surface of the lids 424, 474 may be in contact with first and second discharge surfaces 423 and 473 in which the first and second outlet openings 421 and 471 are formed.

When the check valves 420 and 470 open the outlet openings 421 and 471, the lids 424, 474 may be spaced apart from the discharge surfaces 423 and 473 in the opposite direction to the cartridge 200. The lids 424, 474 may be formed to have an edge thinner than the thickness of the center portion, and thus, the fluid can be escaped through the outlet openings 421 and 471 due to pressure.

The valve necks 425 and 475 may protrude from one surface of the lids 424, 474 and may protrude from the center of one surface. The valve necks 425 and 475 may protrude in a direction toward the cartridge 200 from one surface of the lids 424, 474. The valve necks 425 and 475 may be inserted into first and second insertion holes 422 and 472 described later.

The step portions 426, 476 may be formed in the distal end of the valve necks 425 and 475, and may be formed larger than the diameter of the valve necks 425 and 475. Therefore, the step portions 426 and 476 may be caught in the rear surface of the first and second insertion holes 422 and 472, and the check valves 420 and 470 can be fixed without being separated.

Figure 15:
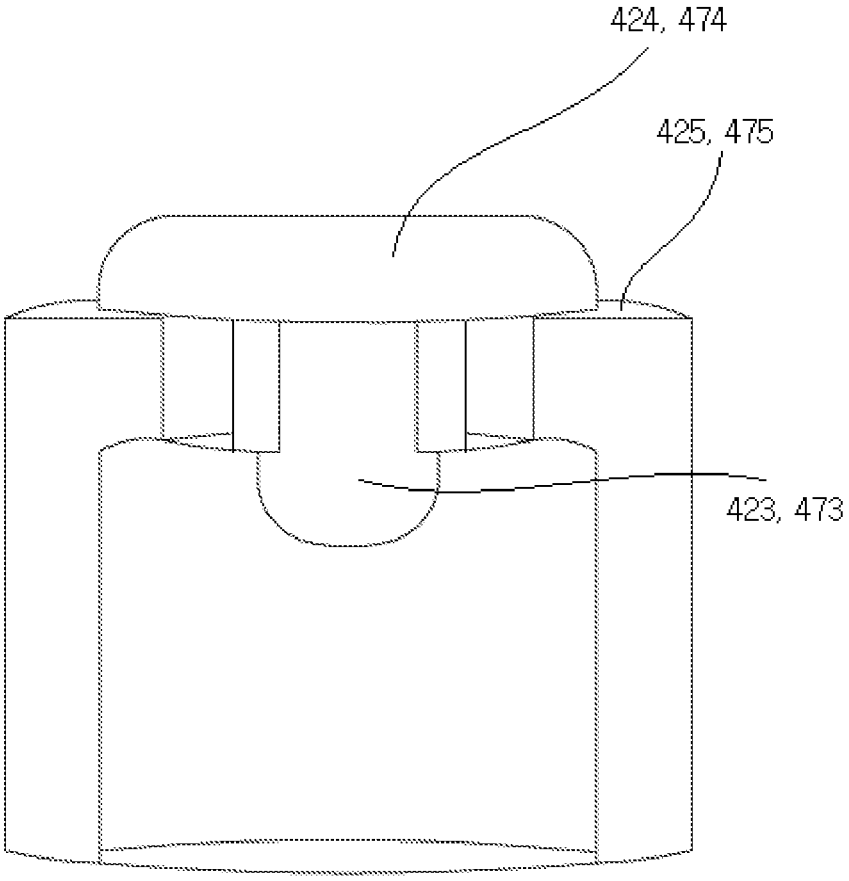
FIG. 15 is a schematic view showing a state that a check valve and an insert hole are mounted of FIGS. 11A and 11B.
Figure 16:
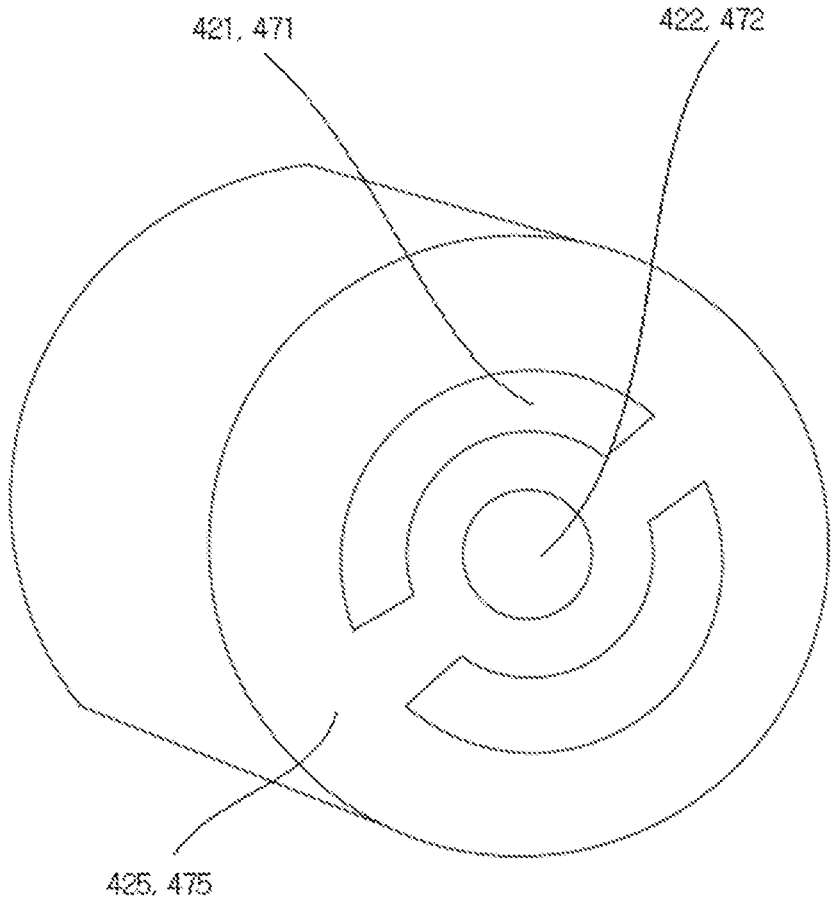
FIG. 16 is a perspective view showing the insert hole.

Referring to FIGS. 15 and 16, the first and second outlet openings 421 and 471 may be formed in a ring shape. The first and second outlet openings 421 and 471 may be formed in a shape of plurality of arcs and may be formed in a ring shape as a whole. First and second insertion holes 422 and 472 into which the first and second check valves 420 and 470 are inserted may be formed in the center of the first and second outlet openings 421 and 471. Meanwhile, FIG. 16 shows a check valve cap 430, but the shapes of the second outlet opening 471 and the second insertion hole 472 formed in the second check valve housing 460 may be the same as the shape of the first outlet opening 421 and the first insertion hole 422.

When the pressure of the fluid through the piston 580 described later is transmitted in the direction of the lids 424, 474 of the first and second check valves 420 and 470, the flat portion of the lids 424, 474 comes in close contact with the abutting first and second outlet openings 421 and 471 due to the pressure of the fluid, thereby closing the first and second outlet openings. Therefore, the additive does not enter the inlet or outlet passage 700 and 800 through the closed first and second outlet openings 421 and 471.

On the other hand, when the pressure of the fluid through the piston 580 is transmitted in the direction of the valve necks 425 and 475 of the first and second check valves 420 and 470, the flat portion of the lids 424, 474 is spaced apart from the abutting first and second outlet openings 421 and 471 due to the pressure of the air, thereby opening the first and second outlet openings. Therefore, the additive may enter the inlet or outlet passage 700 and 800 through the opened first and second outlet openings 421 and 471. This is because the first and second check valves 420 and 470 are formed of an elastic material, and the shape and position of the valve necks 425 and 475 and the lids 424, 474 may be changed by negative pressure or positive pressure.

According to an embodiment of the present disclosure, the first and second check valves 420 and 470 may be formed of rubber. Since the first and second check valves 420 and 470 formed of an elastic material can be manufactured in a compact size in comparison with a check valve using a conventional spring, a structure, such as a spring length and a shaft supporting the spring is not required, so that the check valve can be miniaturized, and the size of the second space S2 formed through the check valve can be reduced.

However, the first and second check valves 420 and 470 are not limited to the above-described structures, and may be the above-described conventional check valve having an elastic stopper, a spring, and a spring shaft.

On the other hand, when the piston 580 of the pump 500 described later reciprocates within the cylinder, a space S2 of the first check valve housing should be formed with a volume equal to or greater than the reciprocating volume formed inside the cylinder. This is because when the piston reciprocating volume inside the cylinder exceeds the volume of the first check valve housing space S2, the additive may overflow into the inlet or outlet passage 700 and 800 described later.

In addition, the first outlet opening 421 may communicate a first space S1 formed in the docking pipe 440 with a second space S2 formed in the first check valve housing 410. The additive stored the first space S1 may discharge to the second space S2 through the first outlet opening 421. The second outlet opening 471 may communicate the second space S2 with a third space S3 formed in the second check valve housing 460. The additive stored the second space S2 may discharge to the third space S3 through the second outlet opening 471. The outlet passage connection pipe 480 connected to the outlet passage 800 disposed at a lower position than the first and second outlet opening 421 and 471. Therefore, the additive that passed through the first and second outlet openings 421, 471 can be well flowed into the outlet passage 800 due to the potential energy.

Hereinafter, the operation of the check valve assembly 400 will be described with reference to FIGS. 11 and 14.

Figure 14A:
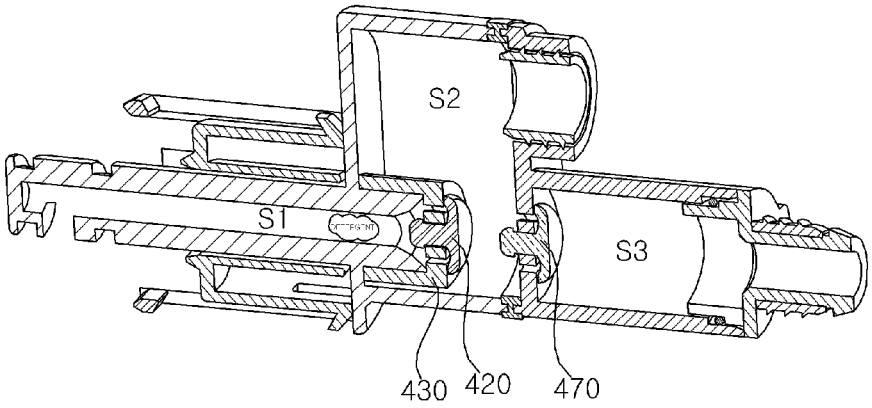
FIGS. 14A to 14C are schematic views showing a state that additive is sucked through the check valve assembly.

FIG. 14A shows the state where the cartridge 200 is inserted into the cartridge receiving space and coupled with the check valve assembly 400, and before the pump 500 is operated, the additive (or detergent) is received in the cartridge 200 and the docking pipe inner space S1.

Figure 14B:
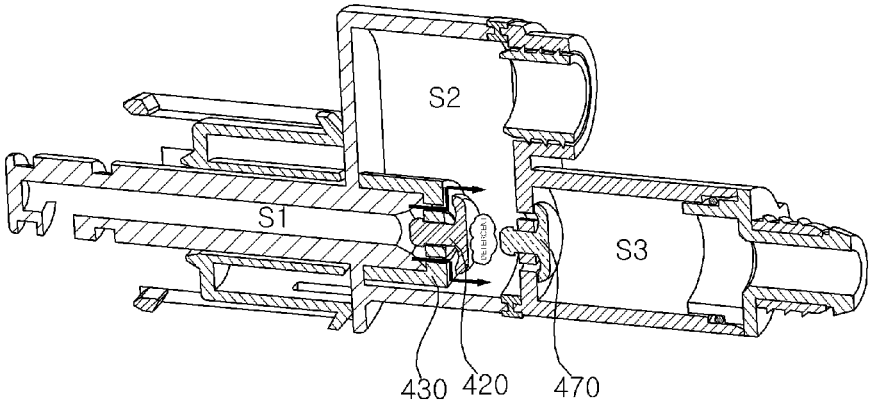

FIG. 14B shows a state where the pressure in the space S2 of the first check valve housing 410 is decreased as the piston 580 moves backward. The pressure is decreased in the space S2 of the first check valve housing 410, so that the first check valve 420 is opened and detergent is extracted into the space S2 of the first check valve housing 410, and the second check valve 470 is closed and detergent is temporarily stored in the space S2 of the first check valve housing 410.

Figure 14C:
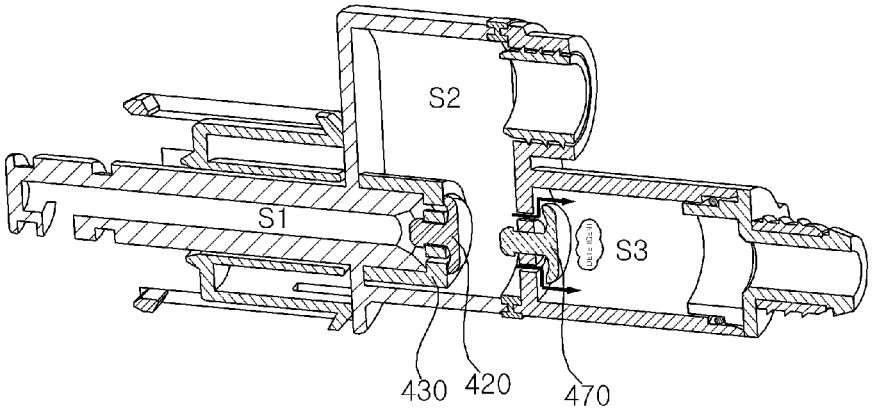

FIG. 14C shows a state in which the pressure in the space S2 of the first check valve housing 410 increases as the piston 580 moves forward. The pressure increases in the space S2 of the first check valve housing 410, so that the first check valve 420 is opened, and the second check valve 470 is closed. Accordingly, the additive temporarily stored in the first check valve housing 410 is discharged to the space S3 of the second check valve housing 460.

The negative pressure or positive pressure generated by the forward/backward movement of the piston 580 provided in the pump 500 is transferred to the space (S2, hereinafter also referred to as a second space) of the first check valve housing 410 through the inlet passage 700.

When the piston 580 moves toward the inlet passage 700 in the cylinder, the first check valve 420 closes the first outlet opening, and the second check valve 470 opens the second outlet opening 471. When the piston 580 moves backward to the opposite side of the inlet passage 700 in the cylinder, the first check valve 420 opens the first outlet opening 421, and the second check valve 470 closes the second outlet opening 471.

According to an embodiment of the present disclosure, the piston 580 moves backward and the negative pressure generated by this is transmitted to the second space S2 through the inlet passage 700. Therefore, the first check valve 420 is opened by the negative pressure applied to the second space S2. In addition, due to the negative pressure applied to the second space S2, the additive in the cartridge 200 enters the second space S2 via the first check valve 420 through the space (S1, hereinafter also referred to as a first space) of the docking pipe 440.

When the additive enters the second space S2, the piston 580 moves forward and the positive pressure generated by this is transferred again to the second space S2 through the inlet passage 700. Therefore, the second check valve 470 is opened by the positive pressure applied to the second space, and the first check valve 420 is positioned while being blocked. Therefore, the additive in the second space S2 is supplied to the space (S3, hereinafter also referred to as a third space) of the second check valve housing 460 due to positive pressure applied to the second space S2. The additive supplied to the third space S3 is discharged to the outlet passage 800 due to the positive pressure applied to the second space S2 and the third space S3, so that it can be supplied to the tub 31 or the drawer 39 together with the supplied water.

As described above, the check valve according to the embodiment of the present disclosure is designed to effectively transmit the pressure change due to the piston reciprocating motion when discharging the additive in the container by applying the pressure change due to the piston motion, and discharges the additive during the reciprocating motion of the piston by using two first and second check valves 420 and 470 so as to move a liquid according to the pressure change.

Hereinafter, the structure and operation of the pump 500 will be described with reference to FIGS. 5 to 8 and 13.

The detergent supply device 100 may include one or two or more pumps 500. The pump 500 may be provided in the number less than the number of cartridges 200.

The detergent supply device 100 includes one pump 500 and one passage switching valve 600 to selectively extract additive contained in the plurality of cartridges 200.

Alternatively, the detergent supply device 100 may include two or more pumps 500 and the same number of passage switching valves 600 as the pumps 500.

For example, the detergent supply device 100 may include two first and second pumps 500 and two first and second passage switching valves 600. The first pump is connected to some cartridges (e.g. 200*a*, 200*b*, 200*c*), which is one or more of the plurality of cartridges 200*a*, 200*b*, 200*c*, 200*d*, 200*e*, 200*f*, through the first passage switching valve, to selectively extract the additive contained therein, and the second pump is connected to the remaining portion of the cartridges (e.g. 200*d*, 200*e*, 200*f*) through the second passage switching valve to selectively extract the additive contained therein.

Alternatively, the detergent supply device 100 may include two or more pumps 500 and fewer passage switching valves 600 than the pumps 500.

For example, the detergent supply device 100 may include two first and second pumps 500 and one passage switching valve 600. The first pump may not be connected to the passage switching valve but may be connected to any one cartridge (e.g. 200*a*) of the plurality of cartridges 200*a*, 200*b*, 200*c*, 200*d*, 200*f*, and can extract the additive contained therein. The second pump may be connected to some of the remaining cartridges (e.g. 200*b*, 200*c*, 200*d*, 200*e*, 200*f*) through the passage switching valve, and can selectively extract the additive contained therein.

Meanwhile, the inlet passage 700 described later may be provided in plural. At least one inlet passage 700 may include two or more passages respectively communicating with two or more check valve assemblies among the plurality of check valve assemblies 400.

The pump 500 may extract the additive by changing the pressure of the space S2 formed in the check valve assembly 400 communicating with two or more passages of the inlet passage 700, and the passage switching valve 600 may selectively communicate the pump 500 with any one of two or more passages of the inlet passage 700. The passage switching valve 600 communicates the cylinder 590 of the pump 500 with any one of two or more passages of the inlet passage 700, and when the pump is operated, the additive may be extracted to the space S2 formed in the check valve assembly communicating with the cylinder 590 and the any one passage.

Meanwhile, when the detergent supply device 100 includes a plurality of pumps 500, cartridges connected to different pumps may be classified and guided to a user to contain additives.

For example, it is known that general detergent and fabric softener are easily hardened when mixing. Therefore, each cartridge may be marked so that the general detergent is contained in any one of the cartridges connected to the first pump, and the fabric softener is contained in any one of the cartridges connected to the second pump. In addition, since babies have weak skin, it is undesirable to mix bleach when washing baby clothes. Accordingly, each cartridge is marked so that the baby clothes detergent may be contained in the other one of the cartridges connected to the first pump, and the bleach may be contained in the other one of the cartridges connected to the second pump.

Hereinafter, the case where the detergent supply device 100 is provided with one pump 500 will be described as an example, but the number of the pumps 500 is not limited to one, and it is sufficient if at least any one pump 500 is connected to two or more cartridges 200 through the passage switching valve 600, the inlet passage 700, and the check valve assembly 400.

The pump 500 may include a pump housing 510 for receiving pump parts, a piston 580 for changing the pressure of the space S2 of the first check valve housing through forward/backward movement, a cylinder 590 for forming a space for the piston to move forward and backward, a motor 520 for generating power, a first gear 530 rotated by the motor 520, a second gear 540 rotating while being in engagement with the first gear, a third gear 550 rotates together with the second gear 540, a crank gear 560 rotates while being in engagement with the third gear, and a connecting rod 570 connecting the crank gear and the piston.

The piston 580 may perform reciprocating motion in a direction parallel to the direction in which the plurality of cartridges 200 are arranged, and the motor 520 may have a drive shaft disposed parallel to the direction in which the piston 580 performs reciprocating motion.

For example, the cartridge 200 is formed long in the front-rear direction of the washing machine, a plurality of cartridges may be installed in a line in the left-right direction of the washing machine, and the piston 580 may perform reciprocating motion in the left-right direction of the washing machine. In addition, the motor 520 may be disposed such that the drive shaft is aligned in the left-right direction.

The first gear 530 is coupled to the drive shaft of the motor 520 and may rotate integrally with the drive shaft. The first gear 530 may be formed of a helical gear. Through the helical gear, noise from the motor 520 may be reduced, and power transmission can be easily performed. The second gear 540 may be formed of a worm gear. Since the pump 500 is located between components such as the inlet, outlet passages 700 and 800, and the passage switching valve 600, it is necessary to allow the assembly receiving space to be dense as far as possible for efficient use of space. Therefore, according to the embodiment of the present disclosure, the motor 520 is installed laid down and the second gear 540 is formed of a worm gear to switch the direction of rotational power and transmit the rotational power.

The second gear 540 and the third gear 550 rotate together. The crank gear 560 rotates while being in engagement with the third gear 550. The number of gear teeth of the crank gear is formed much greater than the number of gear teeth of the third gear 550, so that a stronger force can be transmitted due to the gear ratio during the reciprocating motion of the piston 580.

The crank gear 560 includes a crank shaft 561 forming a rotation axis of the crank gear, a crank arm 562 extended from the crank shaft, and a crank pin 563 connected to the connecting rod 570. The crank pin 563 and the connecting rod 570 are rotatably coupled, and as the crank pin 563 rotates when the crank gear 560 rotates, the connecting rod 570 may move in a straight line in the direction in which the cylinder 590 is formed.

The connecting rod 570 may be coupled to the piston 580, and the piston 580 may be inserted into the cylinder 590 and may reciprocate in the longitudinal direction of the cylinder 590. Through the linear motion of the piston 580, positive or negative pressure may be transmitted to the passage switching valve 600 connected to the cylinder 590. When the piston moves in the direction of the passage switching valve 600, positive pressure is transmitted to the passage switching valve 600, and when the piston moves in the opposite direction of the passage switching valve 600, negative pressure is transmitted to the passage switching valve 600.

Hereinafter, the passage switching valve 600 will be described with reference to FIGS. 5 to 8 and FIGS. 12 to 13.

The passage switching valve 600 is connected to the pump 500 and the inlet passage 700. The passage switching valve 600 selectively communicates the cylinder 590 of the pump 500 with any one (e.g. 700*a*) of the plurality of passages 700 of the inlet passage 700.

As described later, the first outlet passage 800*a* and the second outlet passage 800*b* may be disposed to be spaced apart from each other in a direction in which the plurality of cartridges 200 are arranged. The passage switching valve 600 may be disposed between the first and second outlet passages 800*a* and 800*b*.

The passage switching valve 600 includes a first housing 610 connected to the cylinder 590 of the pump 500, a second housing 650 coupled with the first housing, a disk 620 rotatably disposed in a space formed by the first housing 610 and the second housing, a spring valve 630 installed in the disk 620, a passage switching motor 670 for rotating the disc, a shaft 640 for transmitting the rotational force of the passage switching motor 670 to the disk 620, a micro switch 660 for inputting the rotational position of the disk 620 to the controller 3, and a plane cam 645 that rotates with the shaft 640 to open and close the current flowing through the micro switch 660

The first housing 610 may form an upper shape of the passage switching valve 600, and the second housing 650 may form a lower shape of the passage switching valve 600. Accordingly, the first housing 610 may be referred to as an upper housing 610 and the second housing 650 may be referred to as a lower housing 650.

The spring valve 630 includes a spring 631 that provides elastic force, a spring shaft 632 that prevents the spring 631 from separating, and a cover portion 633 that can cover and block a passage connecting hole 651*a* due to the elastic force of the spring.

The disk 620 has an insertion hole 621 into which the spring shaft 632 is inserted and which fixes the position of the spring valve, and a disk hole 622 through which the fluid passes. The fluid introduced into the passage switching valve 600 may pass through the disk 620 through the disk hole 622, and may also partially pass through the insertion hole 621.

Meanwhile, dissimilarly to this, a water supply port 615 may be formed in the first housing 610 to be connected to the water supply valve 830.

The second housing 650 is provided with a plurality of inlet connection ports 653*a*, 653*b*, 653*c*, 653*d*, 653*e*, 653*f* (hereinafter, 653) respectively coupled to a plurality of passages of the inlet passage 700, and a plurality of passage connecting holes 651 respectively communicating with the plurality of inlet connection ports 653 are formed. The fluid that passed through the disk hole 622 and the insertion hole 621 of the disk 620 may pass through each inlet connection port 653 through the passage connecting hole 651 and may be supplied to each inlet passage 700 connected thereto.

The spring valve 630 may selectively open and close some of the plurality of passage connecting holes 651. When the disk 620 rotates and the spring valve 630 closes some of the plurality of passage connecting holes 651, the remaining portion may be opened.

In order to supply a plurality of additives, a plurality of passage connecting holes 651*a* may be opened, and a plurality of spring valves 630 may also be formed to block a plurality of passage connecting holes.

The spring valve 630 may be provided in a smaller number than the plurality of passage connecting holes 651, and preferably, may be provided in one smaller number than the plurality of passage connecting holes 651. That is, the spring valve 630 may be provided in one smaller number than the number of the plurality of cartridges. In this case, one passage connecting hole 651 can be opened, and the other passage connecting holes 651 can be closed. Thus, the additive can be extracted from the cartridge 200 and discharged to the outlet passage 800 by changing the pressure of the space S2 formed in the check valve assembly 400 connected to one cartridge of the plurality of cartridges 200.

When the additive to be supplied is selected, power is supplied to the passage switching motor 670 to be driven. The driven passage switching motor 670 rotates the shaft 640 connected thereto and the disk 620 connected to the shaft 640.

At this time, the spring valve 630 installed in the disk 620 may also rotate together according to the rotation of the disk, and when the passage connecting hole 651 of the lower housing 650 is located in the rotation position of the spring valve 630, a corresponding passage connecting hole 651 may be blocked by the cover portion 633 due to the elastic force of the spring 631.

In order to connect the pump 500 with the check valve assembly 400 connected to the cartridge 200 containing the additive to be supplied, the controller 3 may control the rotation angle of the disk 620 so that the spring valve 630 is not located in the passage connecting hole 651 connected to the check valve assembly 400.

If the spring valve 630 is not located in the passage connecting hole 651, the pump 500 and the passage connecting hole 651 are opened, and the positive or negative pressure generated in the pump 500 is sequentially transmitted to the inlet passage 700 and the check valve assembly 400 through the passage connecting hole 651, so that the additive of the cartridge 200 may be supplied to the outlet passage 800.

In addition, in order to block the pump 500 and the check valve assembly 400 connected to the cartridge containing the additive that does not need to be supplied, the spring valve 630 may be positioned in the passage connecting hole 651 connected to the check valve assembly 400, and the rotation angle of the disk can be controlled so that the cover portion 633 blocks the passage connecting hole 651*a* due to the elastic force of the spring 631.

When the spring valve 630 is positioned in the passage connecting hole 651, the pump 500 and the passage connecting hole 651 are blocked, and the positive or negative pressure generated by the pump 500 is not transmitted to the check valve assembly 400, so that the additive of the cartridge 200 does not flow.

When the spring valve 630 of the disk 620 is not located in the position of the passage connecting hole 651, the spring valve 630 is located while being compressed on the lower housing upper surface 652, and when the spring valve 630 moves to the position of the passage connecting hole 651 through rotation of the disk 620, the spring valve 630 is tensioned to block the passage connecting hole 651.

In order to accurately control the rotation angle of the disk 620, the passage switching valve 600 includes the micro switch 660 and the plane cam 645. The plane cam 645 may be integrally formed with the shaft 640 or coupled to the shaft 640 to rotate integrally with the shaft 640 and the disk 620.

The micro switch 660 includes an actuator, and an electric circuit can be changed by the movement of the actuator.

The cam is a device having a special contour (or groove) for rotational motion (or reciprocating motion), and the plane cam 645 is a type of the cam, and the contour of the plane cam shows a plane curve.

Figure 8:
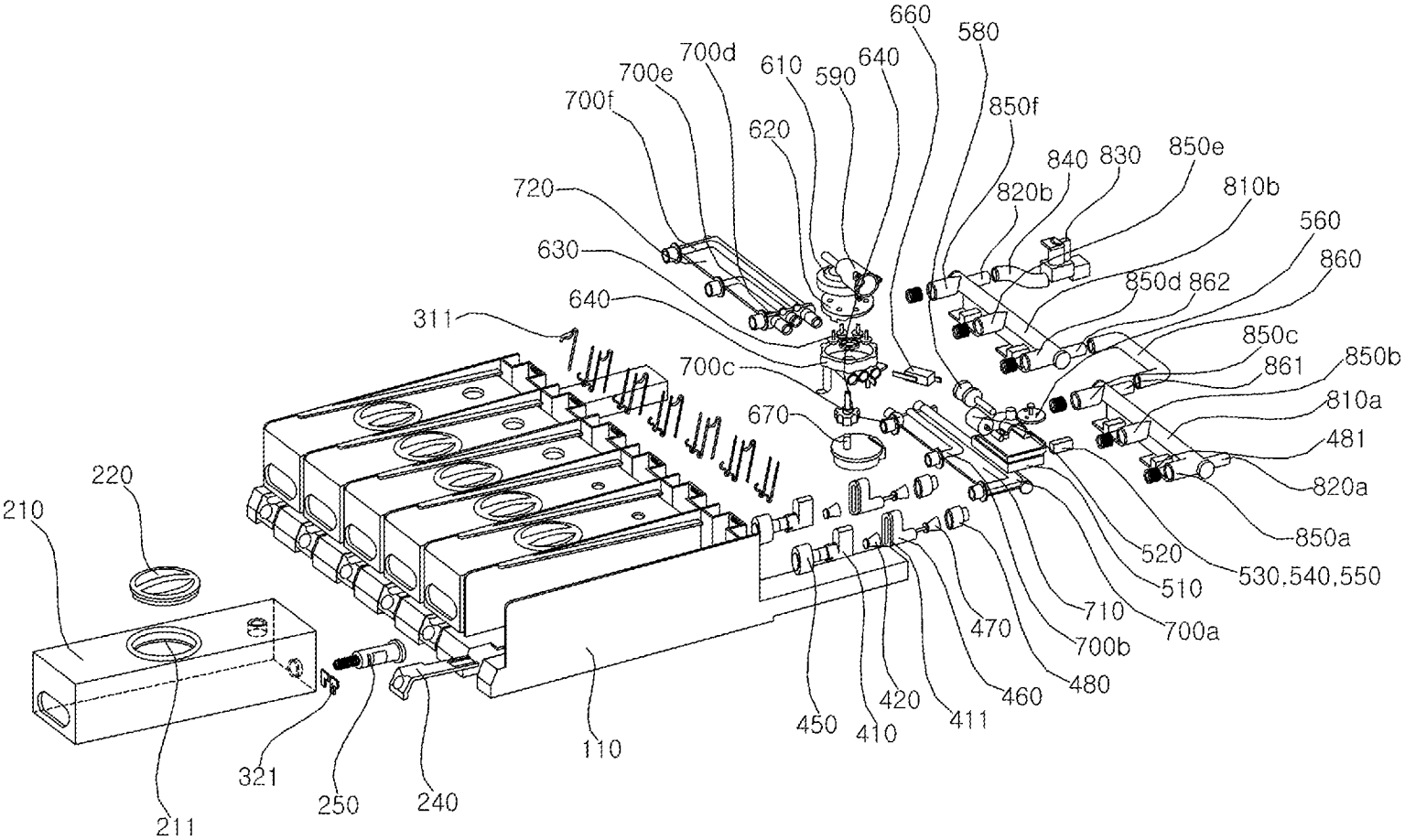
FIG. 8 is an exploded perspective view showing the detergent supply device of FIG. 5.
Figure 9:
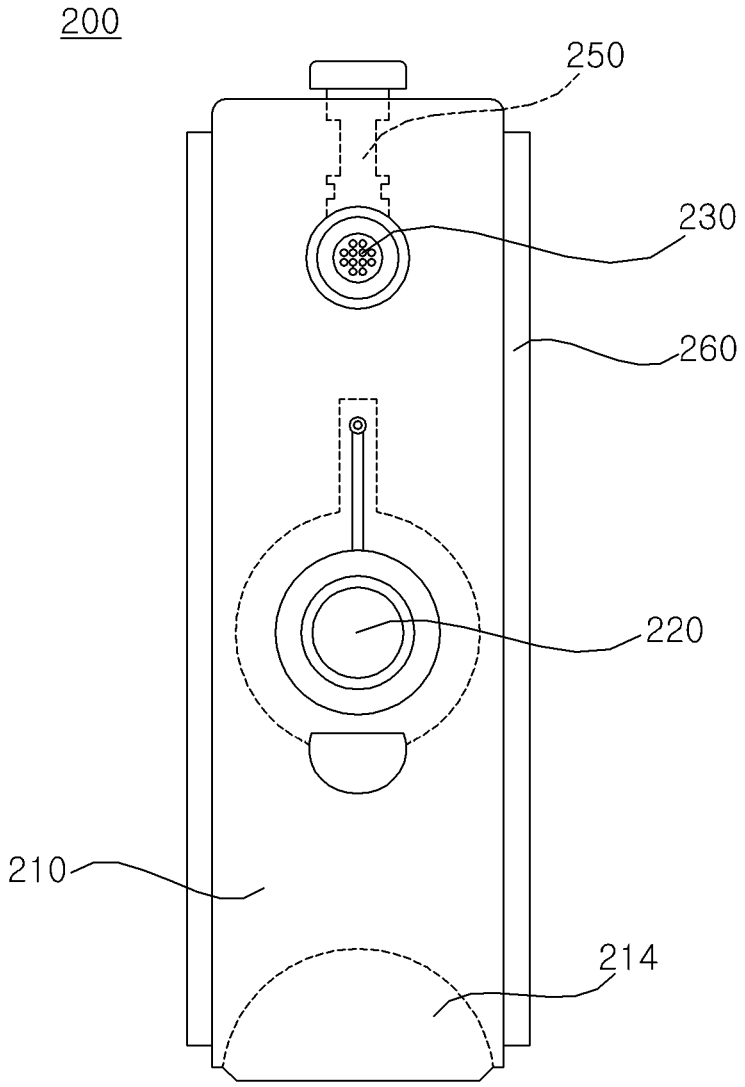
FIG. 9 is a top view showing a cartridge of FIG. 8.
Figure 10:
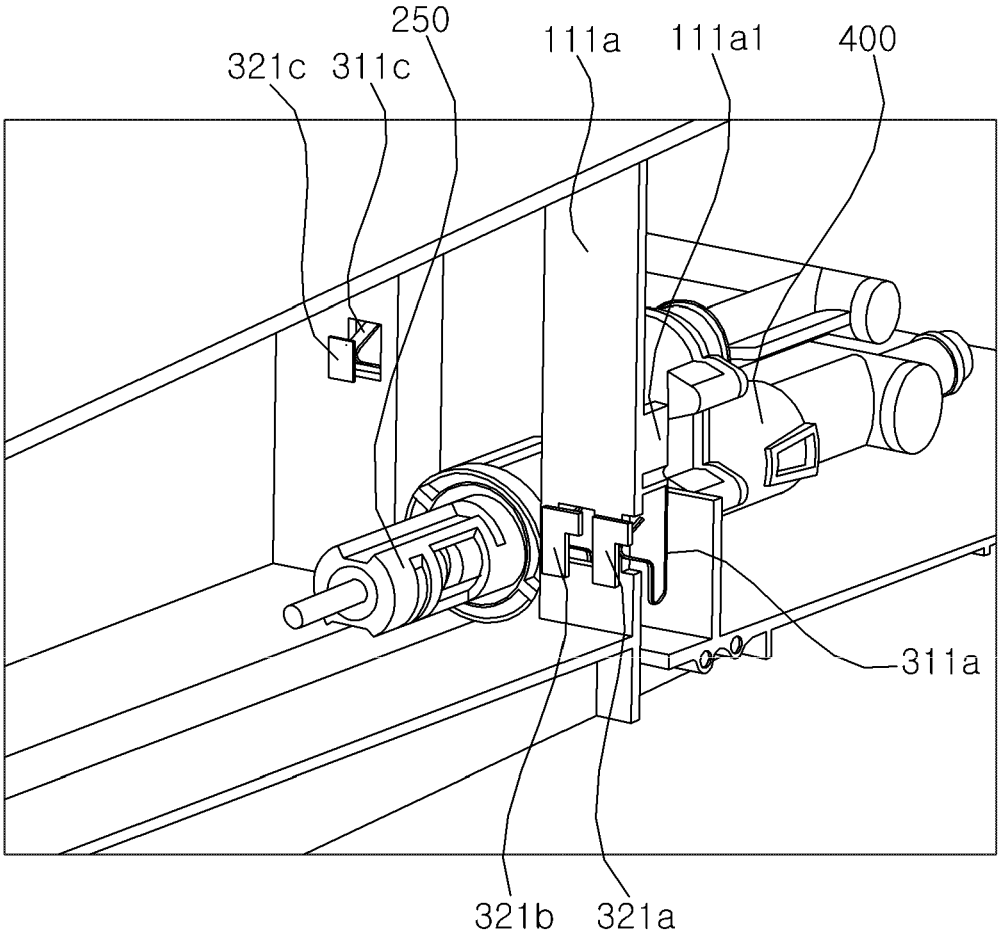
FIG. 10 is a schematic view showing a docking valve, check valve assembly and an electrode sensor of FIG. 8.
Figure 12:
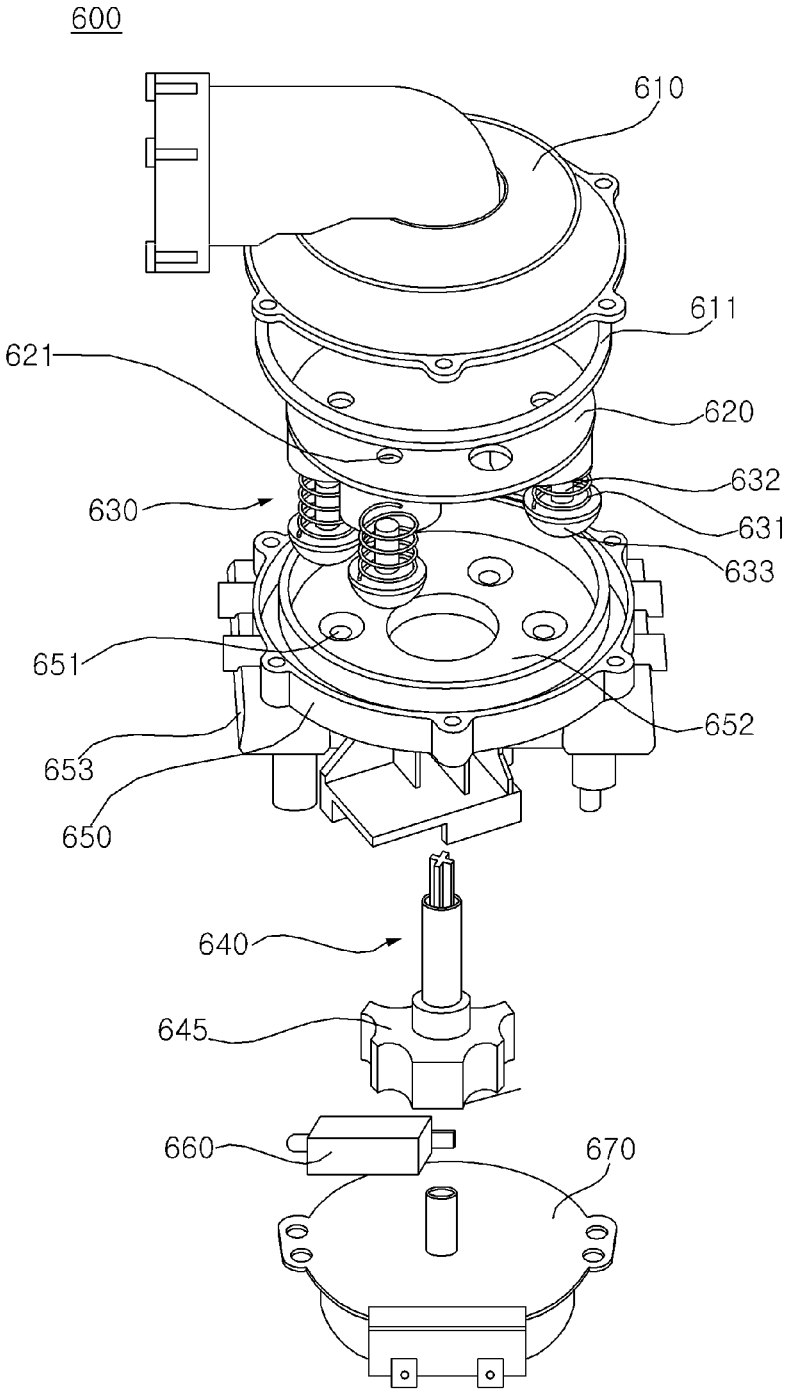
FIG. 12 is an exploded perspective view showing a passage switching valve of FIG. 8.
Figure 13:
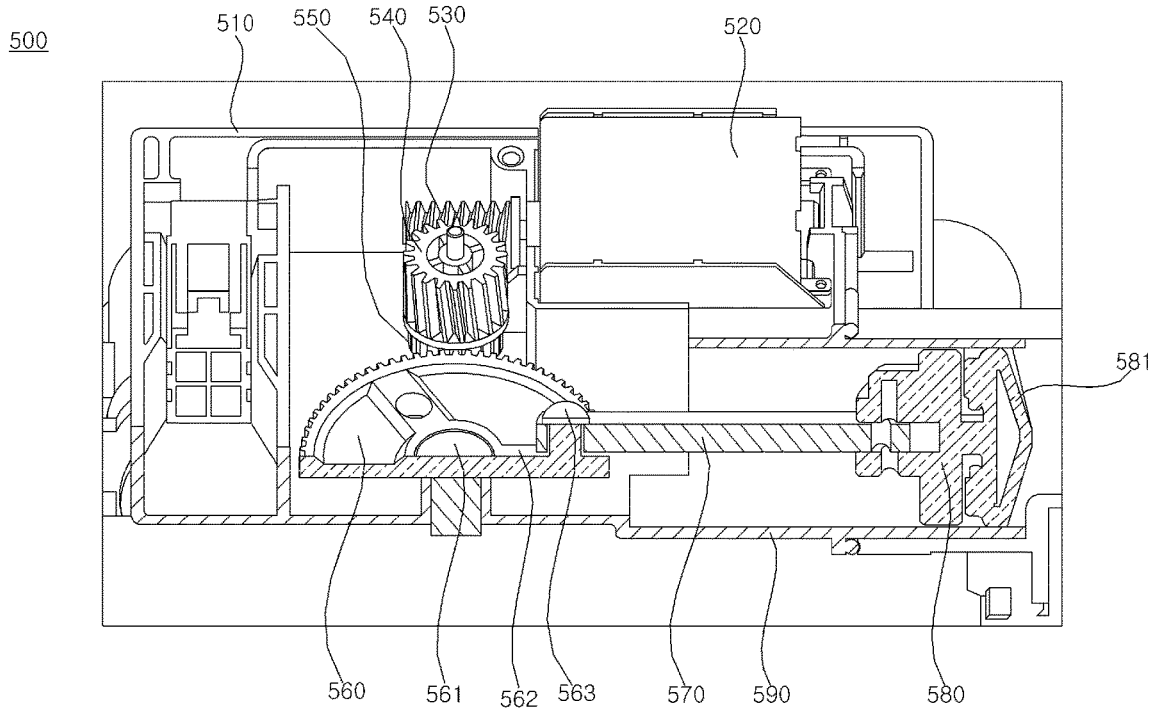
FIG. 13 is a schematic view showing a pump of FIG. 8.

Referring to FIGS. 8 and 12, the plane cam 645 has a special contour by having a plurality of protrusions having different shapes and separation distances, and as the plane cam 645 rotates, the protrusions presses the actuator provided in the micro switch 660 to open and close the current. The controller 3 may determine and control the rotational position of the disk 620 by a pattern of opening and closing the current.

The plane cam 645 and the shaft 640 rotate in combination with the drive shaft of the passage switching motor, and the micro switch 660 is disposed such that the actuator contacts the plane cam 645. In the embodiment of the present disclosure, the passage switching motor 670 is disposed in the lower side of the lower housing 650, and the plane cam 645 and the micro switch 660 may be positioned between the passage switching motor 670 and the lower housing 650.

Hereinafter, the inlet and outlet passages 700 and 800 will be described with reference to FIGS. 5 to 8.

The detergent supply device 100 includes an inlet passage 700 that transmits the pressure change generated by the reciprocating motion of the piston 580 to the space S2 formed in the plurality of check valve assemblies 400. The inlet passage 700 includes a plurality of passages 700*a*, 700*b*, 700*c*, 700*d*, 700*e*, 700*f* respectively communicating with the space S2 formed in the plurality of check valve assemblies 400.

The inlet passage 700 is connected to the passage connector 461 of the check valve assembly 400, and is connected to the inlet connection port 653 of the passage switching valve 600 to transmit the flow of the fluid transmitted through the pump 500 to the check valve assembly 400.

The plurality of passages 700 are connected to a plurality of inlet passage connectors 461 and inlet connection ports 653 respectively.

The inlet passage 700 may include a first inlet passage having a portion 700*a*, 700*b*, 700*c* of the plurality of passages 700*a*, 700*b*, 700*c*, 700*d*, 700*e*, 700*f*, and a second inlet passage having a remaining portion 700*d*, 700*e*, 700*f* of the plurality of passages 700*a*, 700*b*, 700*c*, 700*d*, 700*e*, 700*f*.

Meanwhile, three cartridges 200 and a check valve assembly 400 connected thereto may be disposed respectively in the left and right sides, and the passage switching valve 600 may be located in the center of the rear side of the cartridge.

The first inlet passage 710 and the second inlet passage 720 may be coupled with the passage switching valve 600, and may be symmetrically coupled with respect to a straight line passing through the center of the passage switching valve 600.

The passage 700*a*, 700*b*, 700*c* provided in the first inlet passage 710 may be respectively connected to the inlet passage connector 461 of the left check valve assembly 400*a*, 400*b*, 400*c* and a passage discharge hole 653 formed side by side in the left side of the passage switching valve 600.

The passage 700*d*, 700*e*, 700*f* provided in the second inlet passage 720 may be respectively connected to the inlet passage connector 461 of the right check valve assembly 400*d*, 400*e*, 400*f*, and the passage discharge hole 653 formed side by side in the right side of the passage switching valve 600.

The first inlet passage 710 is integrally formed through a first passage plate 715 to fix a plurality of passages 700*a*, 700*b*, 700*c*, and the second inlet passage 720 is integrally formed through a second passage plate 725 to fix a plurality of passages 700*d*, 700*e*, 700*f*, thereby stably supplying the fluid.

Meanwhile, in the outlet passage 800, the water supplied from the water supply valve 830 and the additive extracted from the cartridge 200 flow. The outlet passage 800 includes a plurality of check valve connection pipes 850*a*, 850*b*, 850*c*, 850*d*, 850*e*, 850*f* (hereinafter, 850) which are respectively connected to a plurality of check valve assemblies 400.

The outlet passage 800 may include a joint pipe 810*a*, 810*b* in which a passage communicating with a plurality of check valve connecting pipes 850 is formed, and through which water supplied from the water supply valve 830 and additive extracted from the cartridge 200 flow, and a discharge port 820*a* which communicates with the passage of the joint pipe 810*a*, 810*b* and is connected to the tub 31 to discharge the water and additive. In addition, the outlet passage 800 may include a water supply port 820*b* which is connected to the water supply valve 830 to receive the water supplied from the water supply valve 830, and communicates with the passage of the joint pipe 810*a*, 810*b*.

The outlet passage 800 is connected to the outlet passage connection pipe 481 of the check valve assembly 400, so that the additive discharged through the outlet passage connection pipe 481 is supplied to the tub 31 or drawer 39 through the discharge hole 820.

The detergent supply device 100 includes a water supply valve 830 receiving water from an external water source, and the water supply valve 830 may be connected to a water supply port 820*b* through a water supply hose 840. The water supplied through the water supply valve 830 passes through the water supply hose 840 and is guided to the outlet passage 800. The water supplied from the water supply valve 830 and the additive extracted from the cartridge 200 may flow in the outlet passage 800.

The guided water flows along the joint pipe 810*a*, 810*b* toward the discharge port 820*a* located in the opposite side of the water supply port 820*b*, and is supplied through the check valve connection pipe 850 to dilute the additive introduced into the outlet passage 800 and be discharged together with the additive to the discharge port 820*b*.

The check valve connection pipe 850 protrudes from the joint pipe 810*a*, 810*b* toward the cartridge (e.g. toward the front), and the discharge port 820*a* and the water supply port 820*b* may protrude toward the rear from the joint pipe 810*a*, 810*b*.

The check valve connection pipe 850 is connected to each outlet passage connection pipe 480, and the additive discharged from the outlet passage connection pipe 480 may be introduced into the outlet passage 800 through the check valve connection pipe 850.

The outlet passage 800 may include the first outlet passage 800*a*, the second outlet passage 800*b*, and a connecting hose 860 which connects the first outlet passage 800*a* and the second outlet passage 800*b*.

The first outlet passage 800*a* may include a portion 850*a*, 850*b*, 850*c* of the plurality of check valve connection pipes, the discharge port 820*a*, and the first joint pipe 810*a* having a passage communicating therewith. The second outlet passage 800*b* may include a remaining portion 850*d*, 850*e*, 850*f* of the plurality of check valve connection pipes, the water supply port 820*b*, and the second joint pipe 810*b* having a passage communicating therewith.

The first outlet passage 800*a* may include a first connection port 861 in communication with the first joint pipe 810*a*, and the second outlet passage 800*b* may include a second connection port 862 in communication with the second joint pipe 810*b*. The connection hose 860 may be connected to the first connection port 861 and the second connection port 862.

The first outlet passage 800*a* and the second outlet passage 800*b* are disposed to be spaced apart from each other in a direction in which a plurality of cartridges 200 are arranged (e.g. the left and right direction of washing machine), and thus the passage switching valve 600 may be disposed in a spaced gap between the first and second outlet passages 800*a*, 800*b*.

In order to prevent the interference between the outlet passage 800 and the passage switching valve 600 as much as possible, the connection hose 860 may be installed in a deflected shape such as u-shape to secure the installation space of the passage switching valve 600.

According to the washing machine of the present disclosure, there are one or more of the following effects.

First, a pump for extracting additive such as detergent stored in the cartridge and a check valve assembly having a space in which the extracted additive is temporarily stored are provided so that the additive can be automatically injected to the tub.

Second, the additive can be prevented from being in direct contact with the pump.

Third, it is possible to automatically inject detergent by using the pump and the check valve assembly, and to enhance space utilization as the first and second check valves, which are integrally formed, made of an elastic material, are provided and the first and second check valves are formed with a simple structure having a lid and a step neck portion.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A washing machine comprising:

a tub configured to receive water;

a drum rotatably provided inside the tub and configured to accommodate laundry therein; and a detergent supply device that is configured to supply an additive to the tub, wherein the detergent supply device comprises:

a cartridge configured to contain the additive, a check valve assembly that includes (i) a check valve configured to control extraction of the additive and (ii) first and second check valve housings defining a space therein configured to receive the extracted additive, a pump configured to extract the additive by changing a pressure in the space defined in the check valve assembly, and an outlet passage configured to pass therethrough the additive received in the first and second check valve housings, wherein the check valve assembly comprises:

a first outlet opening that is in fluid communication with the cartridge and that is located in the first check valve housing, a second outlet opening that is in fluid communication with the outlet passage and that is located in the second check valve housing, a first check valve configured to open or close the first outlet opening, and a second check valve configured to open or close the second outlet opening, and wherein the first and second check valves are configured to open in a same direction.

2. The washing machine of claim 1, wherein the first and second check valves are made of an elastic material and are integrally formed.

3. The washing machine of claim 2, wherein each of the first and second check valves comprises:

a lid having at least one surface that is partially flat, the lid being configured to open and close the outlet opening, and a valve neck protruding from the at least one surface.

4. The washing machine of claim 3, wherein each of a first and second insertion holes is formed in a center of the first and second outlet openings, respectively, and wherein the valve neck of each of the first and second check valves is respectively inserted into each of the first and second insertion holes.

5. The washing machine of claim 4, wherein the first and second check valves comprise a step portion that has a diameter larger than a distal end of the valve neck, and wherein the step portion of the first and second check valves are respectively located on a rear surface of the first and second insertion holes.

6. The washing machine of claim 3, wherein the at least one surface of the lid is in contact with a first and second discharge surfaces on which the first and second outlet openings are formed.

7. The washing machine of claim 6, wherein the valve neck protrudes in a direction toward the cartridge, and wherein the first and second check valves are configured to open in a direction away from the cartridge.

8. The washing machine of claim 1, wherein the check valve assembly comprises:

a docking pipe that is connected to the cartridge and that defines a first space therein, wherein the first check valve housing that is connected to the docking pipe and that defines a second space between the first check valve and the second check valve, wherein the extracted additive is received in the second space, and wherein the second check valve housing that is connected to the first check valve housing and that defines a third space between the second check valve and the outlet passage.

9. The washing machine of claim 8, wherein the docking pipe includes one end of the outlet passage that protrudes into the first check valve housing.

10. The washing machine of claim 9, wherein the check valve assembly further comprises a check valve cap that is coupled to one end of the docking pipe, and wherein the first outlet opening is located in the check valve cap.

11. The washing machine of claim 9, wherein the docking pipe includes the other end of the outlet passage that is inserted into the cartridge, and wherein a detergent inlet opening is located in a lower portion of the inserted portion of the outlet passage and is configured to establish fluid communication between the first space and the cartridge.

12. The washing machine of claim 11, wherein the docking pipe is inclined upward toward the other end of the outlet passage.

13. The washing machine of claim 8, wherein the detergent supply device further comprises a docking valve that is located in the cartridge and that connects the cartridge and the docking pipe.

14. The washing machine of claim 8, wherein the pump is configured to extract the additive by changing an air pressure in the second space.

15. The washing machine of claim 14, wherein the pump comprises:

a cylinder that is in communication with the second space, and a piston that is configured to reciprocate within the cylinder.

16. The washing machine of claim 15, wherein the second space has a volume that is equal to or greater than a volume of a space within the cylinder in which the piston reciprocates.

17. The washing machine of claim 14, wherein the detergent supply device further comprises an inlet passage configured to transmit a pressure change from the pump to the second space.

18. The washing machine of claim 17, wherein the check valve assembly further comprises an inlet passage connecting pipe that is coupled to the first check valve housing and that is located above the second check valve housing, and wherein the inlet passage is coupled to the inlet passage connecting pipe.

19. The washing machine of claim 8, wherein the check valve assembly further comprises an outlet passage connecting pipe coupled to the second check valve housing, and wherein the outlet passage is coupled to the outlet passage connecting pipe.

20. The washing machine of claim 1, further comprising:

a plurality of cartridges, wherein each of the plurality of cartridges contains the additive; and a plurality of check valve assemblies that are respectively connected to the plurality of cartridges.

* * * * *